US012546313B2

(12) United States Patent
Sedri et al.

(10) Patent No.: US 12,546,313 B2
(45) Date of Patent: Feb. 10, 2026

(54) EXTERNAL GEAR PUMP

(71) Applicants: Farhad Sedri, Kerman (IR); Alireza Riasi, Tehran (IR)

(72) Inventors: Farhad Sedri, Kerman (IR); Alireza Riasi, Tehran (IR)

( * ) Notice: Subject to any disclaimer, the term of this patent is extended or adjusted under 35 U.S.C. 154(b) by 36 days.

(21) Appl. No.: 18/839,450

(22) PCT Filed: Feb. 20, 2023

(86) PCT No.: PCT/IB2023/051529
§ 371 (c)(1),
(2) Date: Aug. 19, 2024

(87) PCT Pub. No.: WO2023/156978
PCT Pub. Date: Aug. 24, 2023

(65) Prior Publication Data
US 2025/0163912 A1 May 22, 2025

(51) Int. Cl.
*F04C 2/14* (2006.01)
*F04C 15/06* (2006.01)

(52) U.S. Cl.
CPC ..... *F04C 2/14* (2013.01); *F04C 15/06* (2013.01); *F04C 2240/30* (2013.01); *F04C 2240/50* (2013.01)

(58) Field of Classification Search
CPC ..... F04C 15/06; F04C 2/084; F04C 2/086; F04C 2/14; F04C 2/18; F04C 2240/30; F04C 2240/50; F04C 2240/603
See application file for complete search history.

(56) References Cited

U.S. PATENT DOCUMENTS 4,470,776 A * 9/1984 Kostek ..... F04C 15/0088 418/102
7,479,000 B2 * 1/2009 Klassen ..... F04C 2/084 418/206.4
11,149,729 B2 * 10/2021 George ..... F04C 2/18
2012/0141315 A1 * 6/2012 Seto ..... F04C 14/24 418/142

* cited by examiner

*Primary Examiner* — Jesse S Bogue

(57) ABSTRACT

Disclosed herein is an external gear pump. The external gear pump includes a casing, a first bearing, a second bearing, a driver gear, a first hollow cylinder, a driven gear, a second hollow cylinder, an inlet port, and an outlet port. When a first longitudinal slot of the first hollow cylinder is aligned with a slot from the first plurality of slots of the driver gear, fluid communication is provided between a first inter-teeth space between two consecutive teeth from the first plurality of teeth of the driver gear and the inlet port through a first longitudinal hole of the first hollow cylinder, the first longitudinal slot, and the slot from the first plurality of slots.

9 Claims, 24 Drawing Sheets

104

150

800

900

900

EXTERNAL GEAR PUMP

CROSS-REFERENCE TO RELATED DISCLOSURE

This disclosure is a continuation-in-part of PCT international application PCT/IB2023/051529 filed on Feb. 20, 2023, entitled 'EXTERNAL GEAR PUMP', which claims priority from the U.S. Provisional patent application No. 63/312,110, filed on Feb. 21, 2022, both applications are incorporated herein by reference in their entirety.

TECHNICAL FIELD

The present disclosure, generally, relates to gear pumps. The present disclosure, particularly, relates to external gear pumps, and more particularly relates to an external gear pump for reduction of cavitation and pressure pulsation, specifically, in applications that require high speed pumping.

BACKGROUND ART

Gear pumps are among the most common types of positive displacement pumps. Gear pumps have some advantages such as, but not limited to, compact design and continuous and smooth output. These pumps are mainly used for pumping high-pressure fluids and flow metering. Gear pumps inherently have difficulty with filling the meshing area of the intake side at high speed which may lead to severe cavitation, noise, vibration, and failure.

At the meshing area of the discharge side, the fluid pockets between the gears may shrink in size and repel the fluid relatively fast. The gears' teeth drive the fluid out of the tight gaps between the gears, creating congestion and increasing the local pressure extremely high, leading to high-velocity jets of the fluid. These jets finally dissipate into the outlet zone and reduce the isentropic efficiency. The pulsation magnitude may be proportional to the pump speed.

External gear pumps are, generally, simple in structure. At least, two spur gears are engaged and supported using two side bearing carriers. Usually, two narrow decompression grooves are carved on one face of these bearing carriers adjacent to the gears meshing zone, allowing the fluid to enter and exit this zone. However, these narrow decompression grooves are insufficient for gear pumps with high aspect ratio gears (higher displacement), especially at high speeds. So they are a bottleneck to receiving large amounts of flow, and cannot correctly prevent cavitation and pressure pulsation.

There is, therefore, a need for a gear pump that limits or prevents gear intermesh starvation and congestion, reduces cavitation and pressure pulsations at the meshing area, and generates additional ports to improve filling and discharging.

SUMMARY OF THE DISCLOSURE

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments of the present disclosure, an external gear pump is disclosed. In an exemplary embodiment, the disclosed external gear pump may include a casing, a first bearing carrier, a second bearing carrier, a driver gear, a first dead shaft, a driven gear, a second dead shaft, an inlet port, and an outlet port.

In an exemplary embodiment, the first bearing carrier may be disposed inside the casing and at a first side of the casing. In an exemplary embodiment, the second bearing carrier may be disposed inside the casing and at a second side of the casing. In an exemplary embodiment, the second side of the casing may be opposite to the first side of the casing.

In an exemplary embodiment, the driver gear may be disposed inside the casing. In an exemplary embodiment, the driver gear may be mounted on the first bearing carrier and the second bearing carrier. In an exemplary embodiment, the driver gear may be configured to rotate around a driver axis and in a first rotational direction. In an exemplary embodiment, the driver gear may be connected to a motor. In an exemplary embodiment, the motor may be configured to urge the driver gear to rotate around the driver axis and in the first rotational direction.

In an exemplary embodiment, the driver gear may include a first hole, a first plurality of teeth, a first plurality of root surfaces, and a first plurality of slots. In an exemplary embodiment, the first plurality of teeth and the first plurality of root surfaces may be arranged alternatively around the driver gear. In an exemplary embodiment, the first plurality of slots may be provided on the first plurality of root surfaces. In an exemplary embodiment, each of the first plurality of slots may be configured to provide fluid communication between the first hole and a respective first inter-teeth space between two consecutive teeth from the first plurality of teeth.

In an exemplary embodiment, the first dead shaft may be disposed inside the first hole. In an exemplary embodiment, the first dead shaft may fixedly be attached to the first bearing carrier. In an exemplary embodiment, the first dead shaft may include a first longitudinal hole and a first lateral slot. In an exemplary embodiment, the first lateral slot may be configured to provide fluid communication between the first longitudinal hole and an outer space of the first dead shaft.

In an exemplary embodiment, the driven gear may be disposed inside the casing. In an exemplary embodiment, the driver gear may be mounted on the first bearing carrier and the second bearing carrier. In an exemplary embodiment, the driven gear may meshedly be engaged with the driver gear. In an exemplary embodiment, the driven gear may be configured to rotate around a driven axis and in a second rotational direction responsive to rotating the driver gear around the driven axis. In an exemplary embodiment, the second rotational direction may be opposite to the first rotational direction.

In an exemplary embodiment, the driven gear may include a second hole, a second plurality of teeth, a second plurality of root surfaces, and a second plurality of slots. In an exemplary embodiment, the second plurality of teeth and the second plurality of root surfaces may be arranged alternatively around the driven gear. In an exemplary embodiment, the second plurality of slots may be provided on the second plurality of root surfaces. In an exemplary embodiment, each of the second plurality of slots may be configured to provide fluid communication between the second hole and a second inter-teeth space between two consecutive teeth from the second plurality of teeth.

In an exemplary embodiment, the second dead shaft may be disposed inside the second hole. In an exemplary embodiment, the second dead shaft may fixedly be attached to the first bearing carrier. In an exemplary embodiment, the second dead shaft may include a second longitudinal hole and a second lateral slot. In an exemplary embodiment, the second lateral slot may be configured to provide fluid communication between the second longitudinal hole and an outer space of the second dead shaft.

In an exemplary embodiment, the inlet port may be at a third side of the casing. In an exemplary embodiment, the driver gear and the driven gear may be configured to suck a fluid from the inlet port at a low pressure. In an exemplary embodiment, the outlet port may be at a fourth side of the casing. In an exemplary embodiment, the driver gear and the driven gear may be configured to pump the fluid to the outlet port at a high pressure. In an exemplary embodiment, the fourth side of the casing may be opposite to the third side of the casing.

In an exemplary embodiment, the first lateral slot may face toward the inlet port and the driven gear. In an exemplary embodiment, the second lateral slot may face toward the inlet port and the driver gear. In an exemplary embodiment, the first longitudinal hole may be in fluid communication with the inlet port. In an exemplary embodiment, the second longitudinal hole may be in fluid communication with the inlet port. In an exemplary embodiment, when the first lateral slot is aligned with a slot from the first plurality of slots, fluid communication may be provided between the first inter-teeth space between two consecutive teeth from the first plurality of teeth and the inlet port through the first longitudinal hole, the first lateral slot, and the slot from the first plurality of slots.

In an exemplary embodiment, when the second lateral slot is aligned with a slot from the second plurality of slots, fluid communication may be provided between the second inter-teeth space between two consecutive teeth from the second plurality of teeth and the inlet port through the second longitudinal hole, the second lateral slot, and the slot from the second plurality of slots.

In an exemplary embodiment, the external gear pump may further include a rear cover. In an exemplary embodiment, the rear cover may be configured to be attached to the first side of the casing. In an exemplary embodiment, the rear cover may include a groove path. In an exemplary embodiment, the groove path may be configured to provide fluid communication between the first longitudinal hole and the inlet port and provide fluid communication between the second longitudinal hole and the inlet port.

In an exemplary embodiment, the groove path may include a first recession, a second recession, and a third recession. In an exemplary embodiment, the first recession may directly be connected to the first longitudinal hole. In an exemplary embodiment, the second recession may directly be connected to the second longitudinal hole. In an exemplary embodiment, the third recession may be in fluid communication with the inlet port through a first channel. In an exemplary embodiment, the first recession, the second recession, and the third recession may be in fluid communication with each other.

In an exemplary embodiment, the first bearing carrier may include multiple groove paths. These groove paths may be configured to provide fluid communication between the longitudinal holes and the inlet port, as well as between other longitudinal holes and the outlet port. Additionally, these groove paths may facilitate fluid flow throughout the gear pump, contributing to efficient operation by ensuring consistent fluid dynamics.

The groove paths on the first bearing carrier may include multiple recessions and lateral slots. For instance, certain recessions may be directly connected to corresponding lateral slots, enabling fluid communication through internal channels to the inlet port. Similarly, other recessions associated with different longitudinal holes may facilitate fluid communication to the outlet port. This configuration may enhance fluid dynamics within the gear pump, potentially reducing cavitation and pressure pulsations during operation.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Figure 1A:
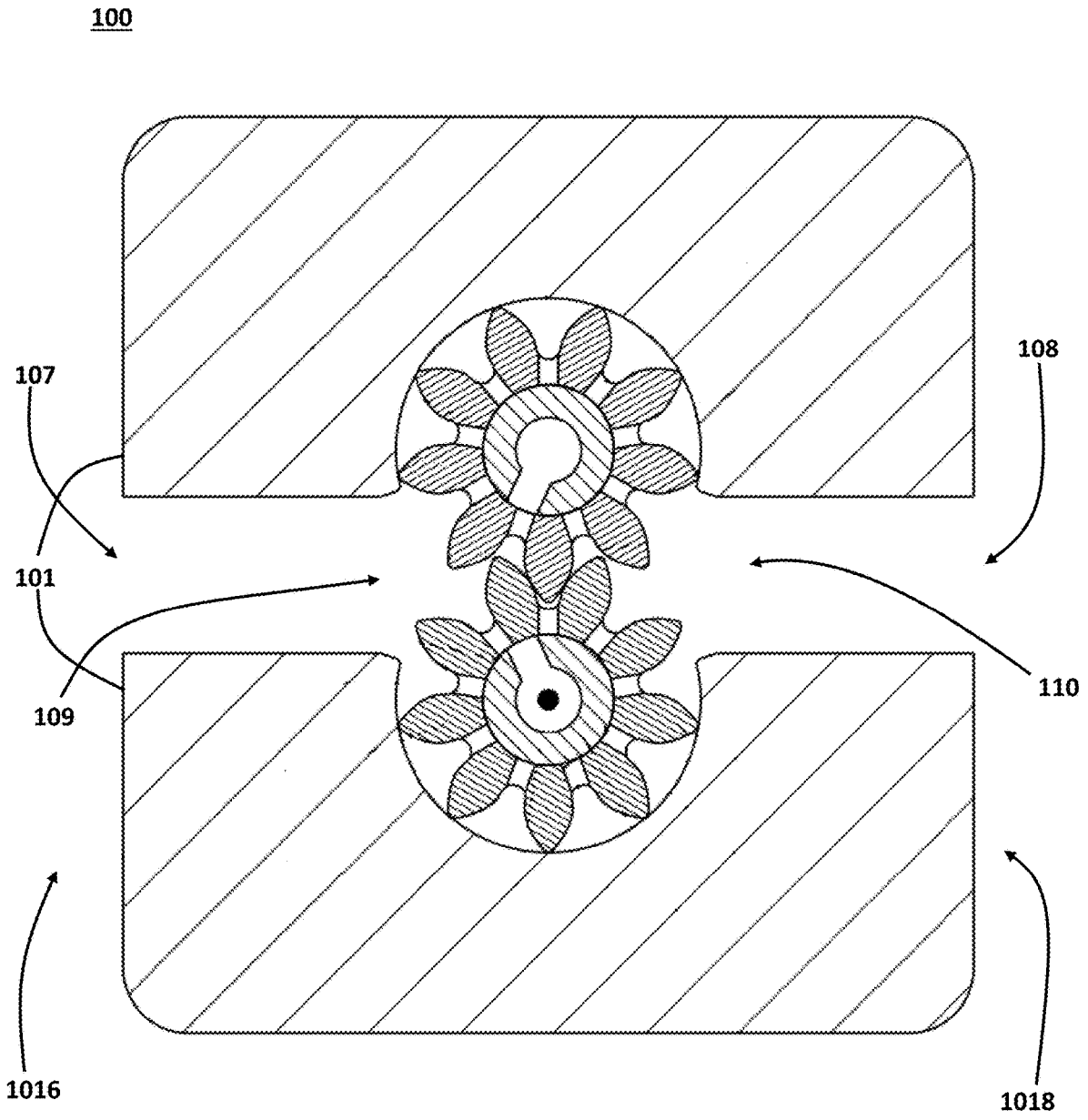
FIG. 1A illustrates a section side view of an external gear pump, consistent with one or more exemplary embodiments of the present disclosure.
Figure 1B:
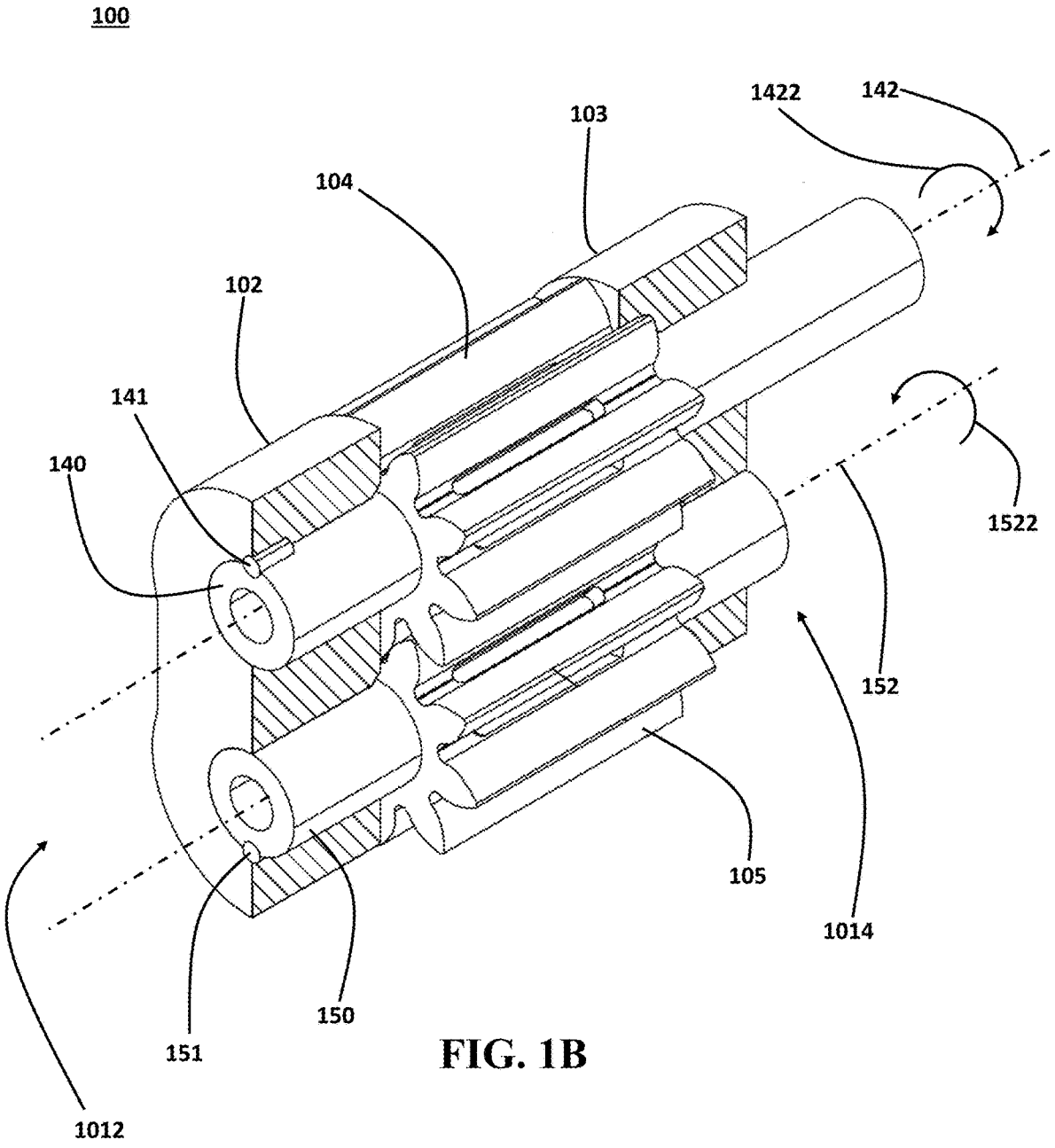
FIG. 1B illustrates a perspective section view of an external gear pump, consistent with one or more exemplary embodiments of the present disclosure.

FIG. 1A shows a section side view of an external gear pump 100, consistent with one or more exemplary embodiments of the present disclosure. FIG. 1B shows a perspective section view of external gear pump 100, consistent with one or more exemplary embodiments of the present disclosure. In an exemplary embodiment, external gear pump 100 may be used to reduce cavitation and pressure pulsation, specifically, for applications that require high-speed pumping. As shown in FIG. 1A and FIG. 1B, in an exemplary embodiment, external gear pump 100 may include a casing 101, a first bearing carrier 102, and a second bearing carrier 103. In an exemplary embodiment, first bearing carrier 102 may be disposed inside casing 101 and at a first side 1012 of casing 101. In an exemplary embodiment, second bearing carrier 103 may be disposed inside casing 101 and at a second side 1014 of casing 101. In an exemplary embodiment, second side 1014 of casing 101 may be opposite to first side 1012 of casing 101.

As further shown in FIG. 1B, in an exemplary embodiment, external gear pump 100 may further include a driver gear 104 and a driven gear 105. In an exemplary embodiment, driver gear 104 may be disposed inside casing 101. In an exemplary embodiment, driver gear 101 may be mounted on first bearing carrier 102 and second bearing carrier 103. In an exemplary embodiment, driver gear 104 may be configured to rotate around a driver axis 142 and in a first rotational direction 1422. In an exemplary embodiment, driver gear 104 may be connected to a motor (not shown in figures). In an exemplary embodiment, the motor may be configured to urge driver gear 104 to rotate around driver axis 142 and in first rotational direction 1422.

Figure 2A:
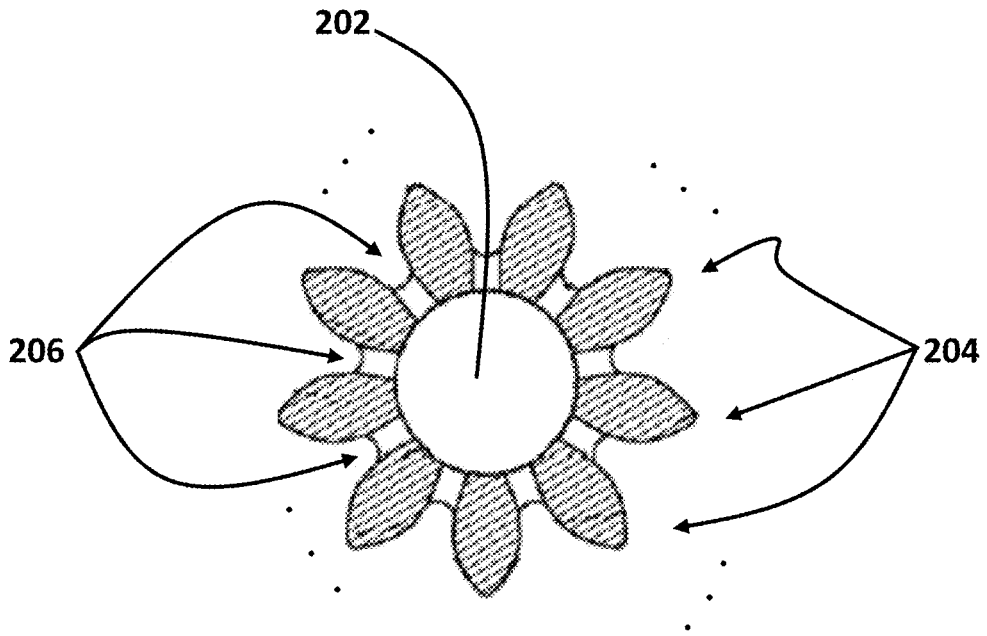
FIG. 2A illustrates a section side view of a driver gear, consistent with one or more exemplary embodiments of the present disclosure.
Figure 2B:
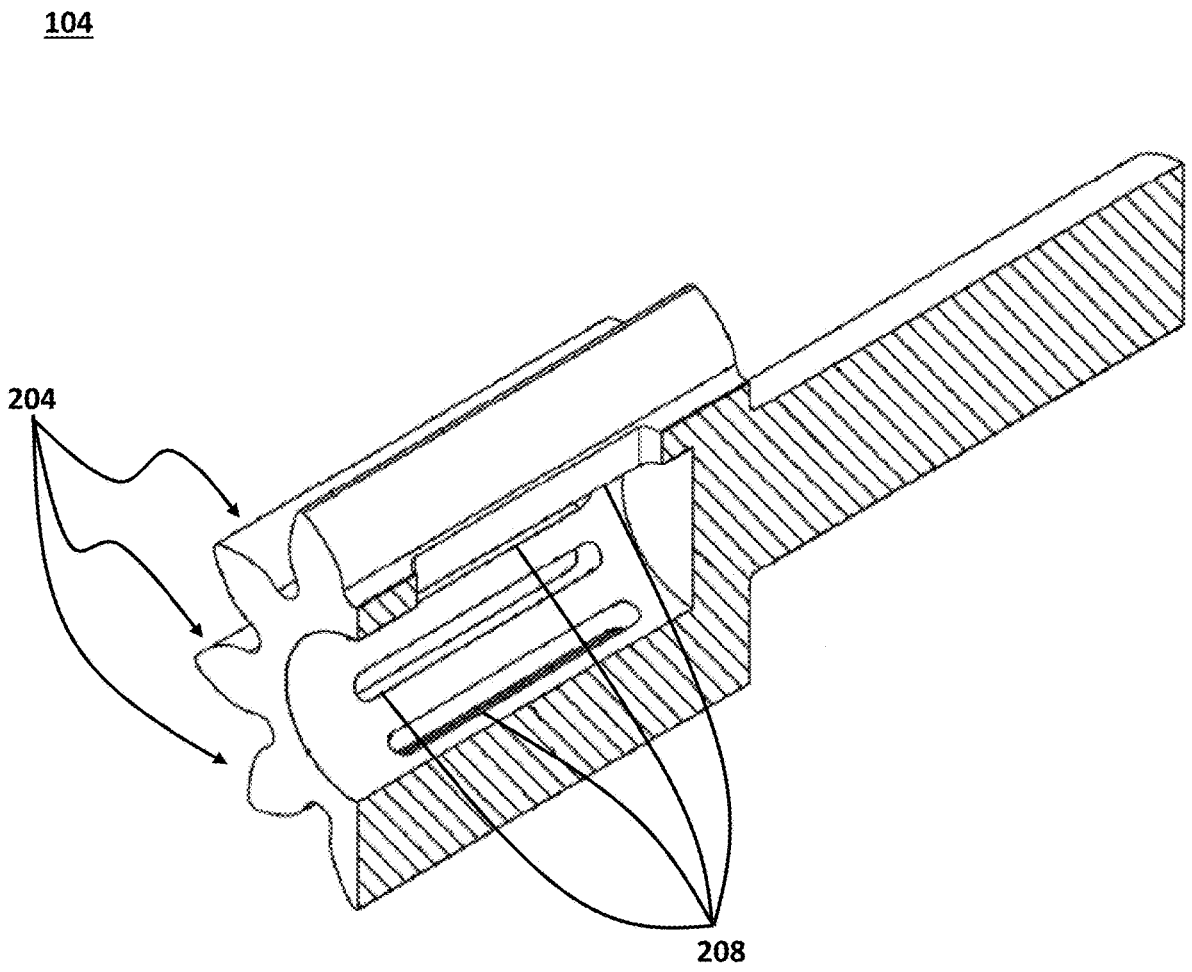
FIG. 2B illustrates a perspective section view of a driver gear, consistent with one or more exemplary embodiments of the present disclosure.
Figure 2C:
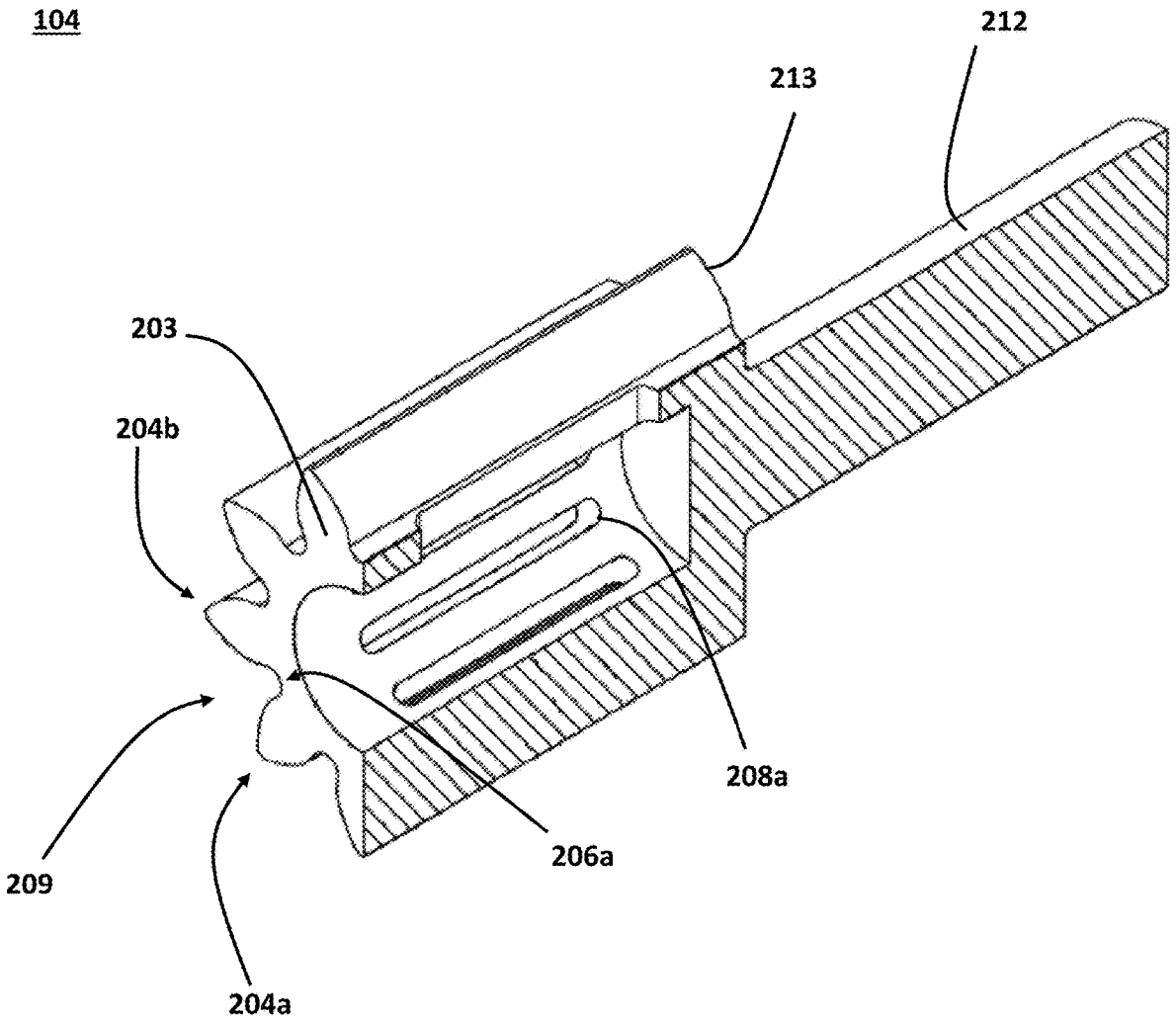
FIG. 2C illustrates a perspective section view of a driver gear, consistent with one or more exemplary embodiments of the present disclosure.

FIG. 2A shows a section side view of driver gear 104, consistent with one or more exemplary embodiments of the present disclosure. FIG. 2B shows a perspective section view of driver gear 104, consistent with one or more exemplary embodiments of the present disclosure. FIG. 2C shows a perspective section view of driver gear 104, consistent with one or more exemplary embodiments of the present disclosure. In an exemplary embodiment, driver gear 104 may include a first hole 202 on a first face 203. In an exemplary embodiment, driver gear 104 may further include a first plurality of teeth 204 and a first plurality of root surfaces 206 arranged alternatively around driver gear 104. In an exemplary embodiment, driver gear 104 may further include a first plurality of slots 208. In an exemplary embodiment, first plurality of slots 208 may be provided on first plurality of root surfaces 206. In an exemplary embodiment, each of first plurality of slots 208 may be configured to provide fluid communication between first hole 202 and a respective first inter-teeth space between two consecutive teeth from first plurality of teeth 204. For example, a first slot 208*a* from first plurality of slots 208 may be provided at a first root surface 206*a* from first plurality of root surfaces 206. In an exemplary embodiment, first slot 208*a* may be configured to provide fluid communication between first hole 202 and a first inter-teeth space 209. In an exemplary embodiment, first inter-teeth space 209 may refer to a space between a first tooth 204*a* from first plurality of teeth 204 and a second tooth 204*b* from first plurality of teeth 204. In an exemplary embodiment, driver gear 104 may further include a first live shaft 212 on a second face 213.

Figure 3A:
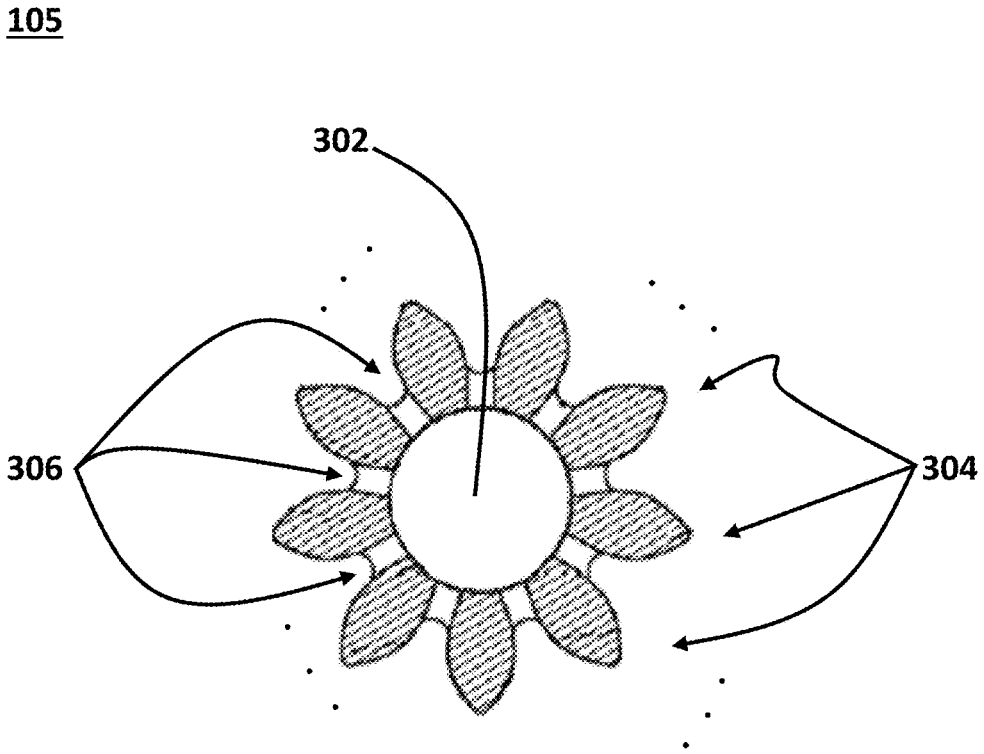
FIG. 3A illustrates a section side view of a driven gear, consistent with one or more exemplary embodiments of the present disclosure.
Figure 3B:
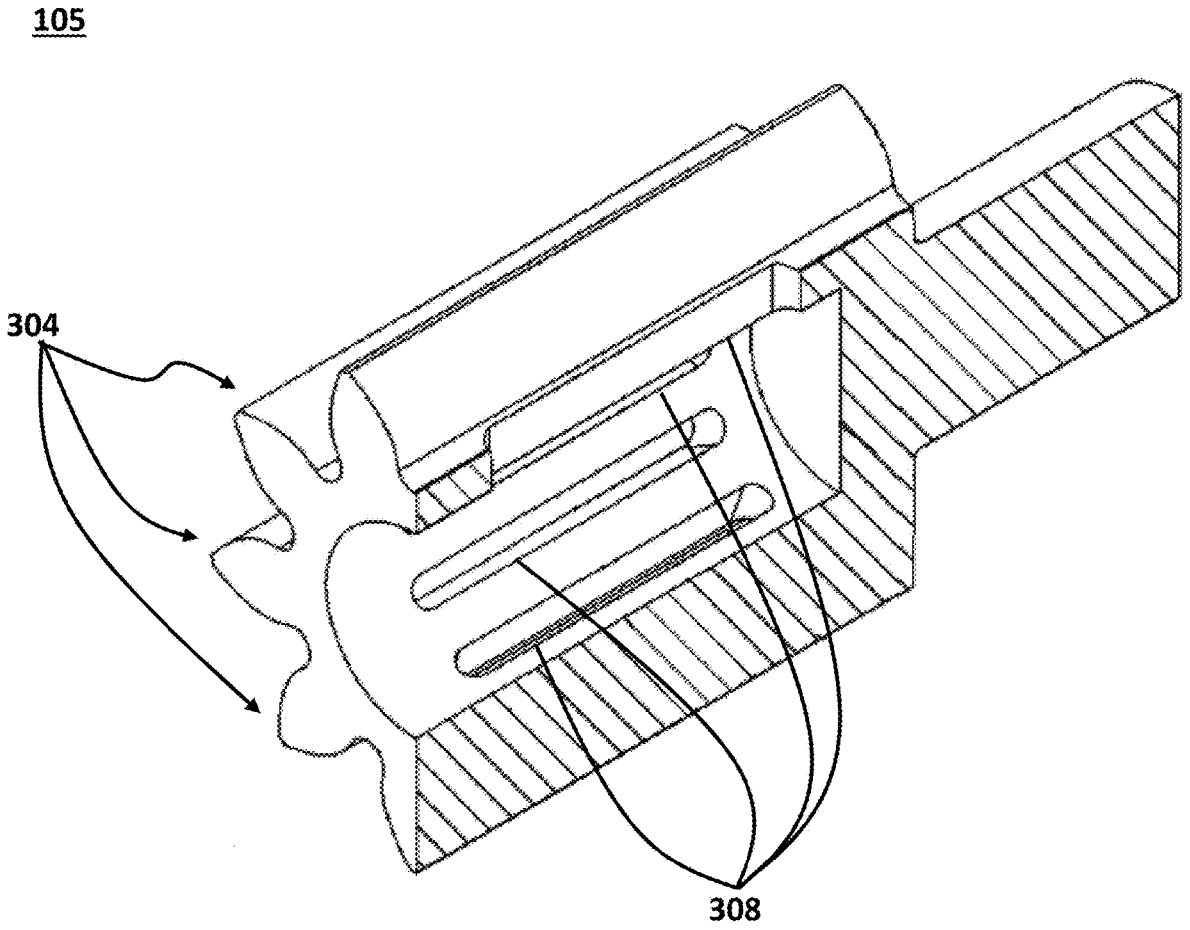
FIG. 3B illustrates a perspective section view of a driven gear, consistent with one or more exemplary embodiments of the present disclosure.
Figure 3C:
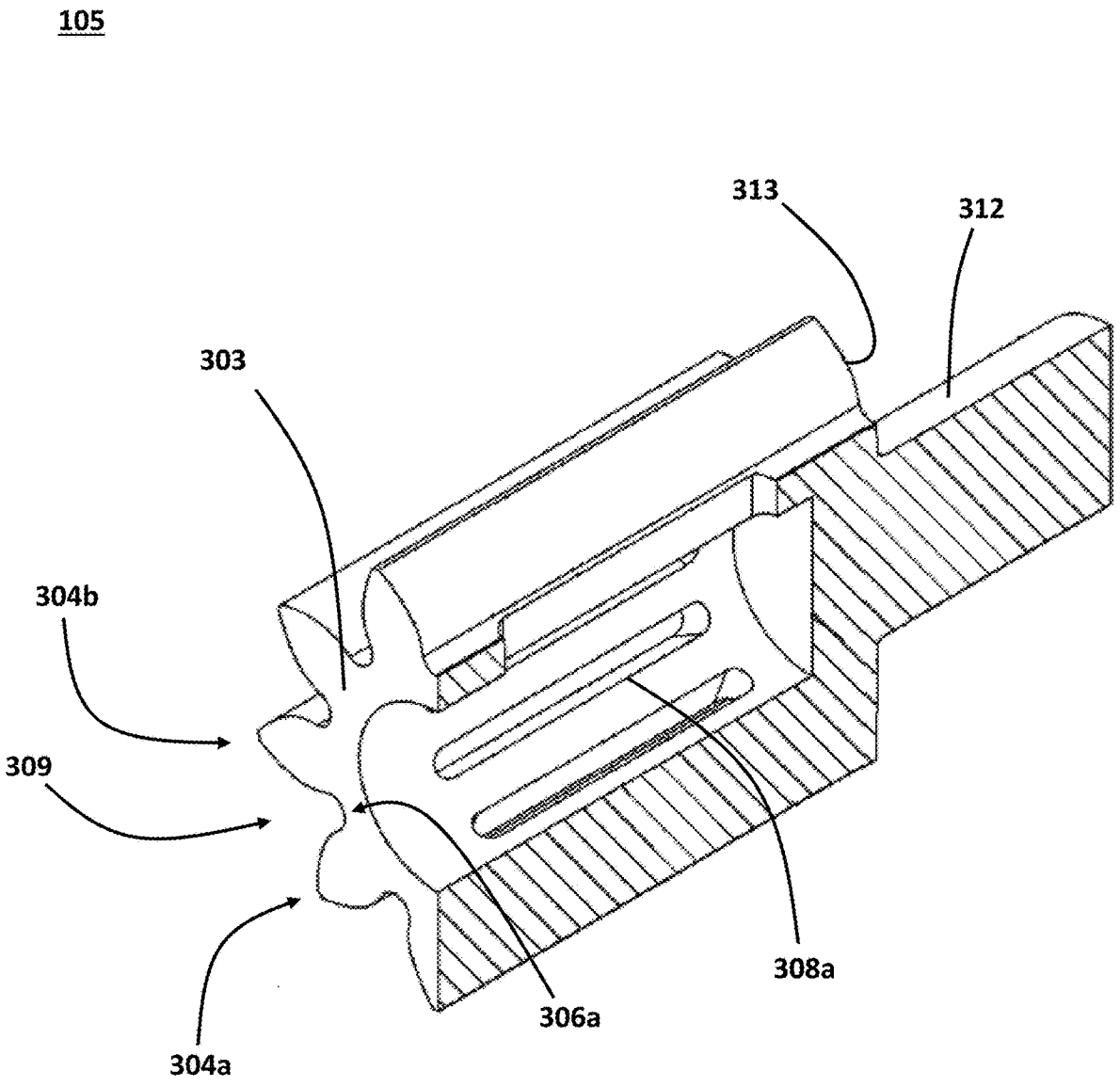
FIG. 3C illustrates a perspective section view of a driven gear, consistent with one or more exemplary embodiments of the present disclosure.

FIG. 3A shows a section side view of driven gear 105, consistent with one or more exemplary embodiments of the present disclosure. FIG. 3B shows a perspective section view of driven gear 105, consistent with one or more exemplary embodiments of the present disclosure. FIG. 3C shows a perspective section view of driven gear 105, consistent with one or more exemplary embodiments of the present disclosure. In an exemplary embodiment, driven gear 105 may include a second hole 302 on a third face 303. In an exemplary embodiment, driven gear 105 may further include a second plurality of teeth 304 and a second plurality of root surfaces 306 arranged alternatively around driven gear 105. In an exemplary embodiment, driven gear 105 may further include a second plurality of slots 308. In an exemplary embodiment, second plurality of slots 308 may be provided on second plurality of root surfaces 306. In an exemplary embodiment, each of second plurality of slots 308 may be configured to provide fluid communication between second hole 302 and a respective second inter-teeth space between two consecutive teeth from second plurality of teeth 304. For example, a second slot 308*a* from second plurality of slots 308 may be provided at a second root surface 306*a* from second plurality of root surfaces 306. In an exemplary embodiment, second slot 308*a* may be configured to provide fluid communication between second hole 202 and a second inter-teeth space 309. In an exemplary embodiment, second inter-teeth space 309 may refer to a space between a third tooth 304*a* from second plurality of teeth 304 and a fourth tooth 304*b* from second plurality of teeth 304. In an exemplary embodiment, driven gear 105 may further include a second live shaft 312 on a fourth face 313.

As further shown in FIG. 1A and FIG. 1B, in an exemplary embodiment, external gear pump 100 may further include a first dead shaft 140. In an exemplary embodiment, first dead shaft 140 may be disposed inside first hole 202. In an exemplary embodiment, first dead shaft 140 may be disposed inside first hole 202 in such a way that driver gear 104 is able to rotate around driver axis 142 without rotation of first dead shaft 140. In an exemplary embodiment, first dead shaft 140 may be fixedly attached to first bearing carrier 102. In an exemplary embodiment, first dead shaft 140 may be fixedly attached to first bearing carrier 102 utilizing a first key 141.

Figure 4A:
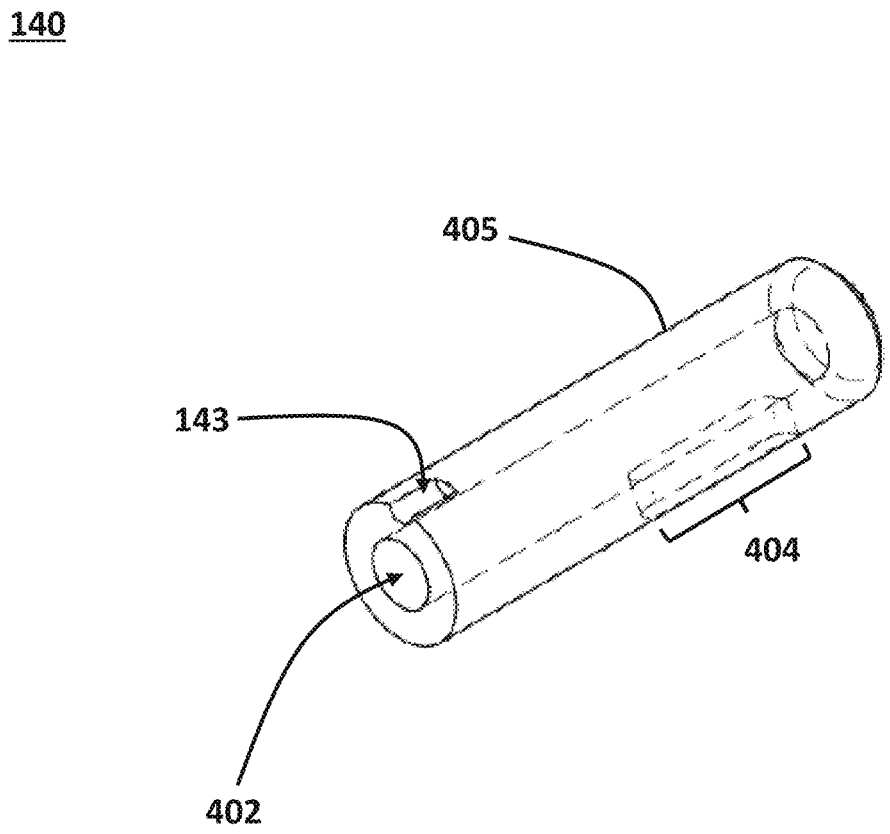
FIG. 4A illustrates a perspective view of a first dead shaft, consistent with one or more exemplary embodiments of the present disclosure.
Figure 4B:
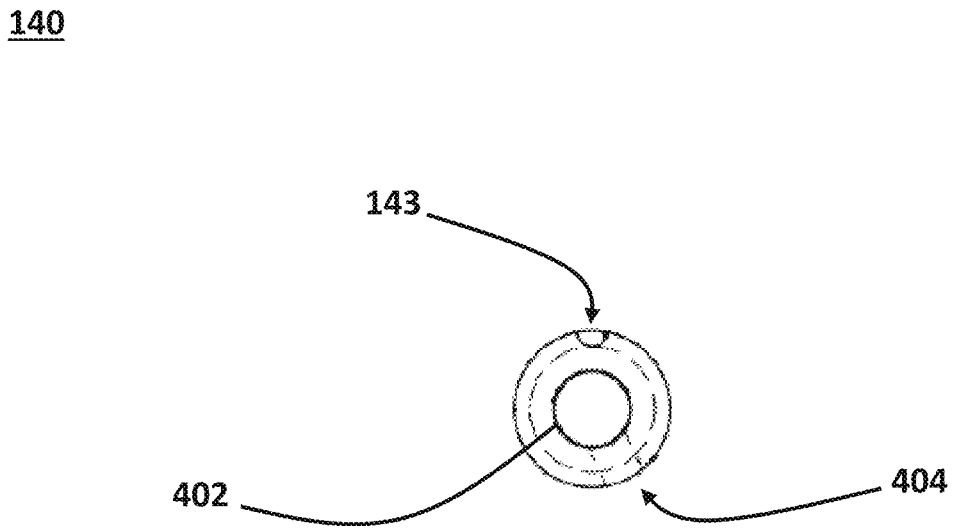
FIG. 4B illustrates a side view of a first dead shaft, consistent with one or more exemplary embodiments of the present disclosure.

FIG. 4A shows a perspective view of first dead shaft 140, consistent with one or more exemplary embodiments of the present disclosure. FIG. 4B shows a side view of first dead shaft 140, consistent with one or more exemplary embodiments of the present disclosure. As shown in FIG. 4A and FIG. 4B, in an exemplary embodiment, first dead shaft 140 may include a first keyway 143. In an exemplary embodiment, first bearing carrier 102 may also include a second keyway associated with first keyway 143. In an exemplary embodiment, first keyway 143 and the second keyway may be configured to receive first key first 141. In an exemplary embodiment, when first key 141 is inserted into first keyway 143 and the second keyway, first dead shaft 140 may be fixedly attached to first bearing carrier 102. In an exemplary embodiment, it should be understood that when first dead shaft 140 is fixedly attached to first bearing carrier 102, during rotation of driver gear 104, first dead shaft 140 may remain stationary.

As further shown in FIG. 4A and FIG. 4B, in an exemplary embodiment, first dead shaft 140 may further include a first longitudinal hole 402, and a first lateral slot 404 on a first lateral face 405. In an exemplary embodiment, first lateral slot 404 may be configured to provide fluid communication between first longitudinal hole 402 and an outer space of first dead shaft 140. In an exemplary embodiment, during rotation of driver gear 104, when a respective slot from first plurality of slots 208 is aligned with first lateral slot 404, fluid communication may be provided between first longitudinal hole 402 and a respective inter-teeth space of driver gear 104 through the respective slot and first lateral slot 404. For example, during rotation of driver gear 104, when first slot 208*a* from first plurality of slots 208 is aligned with first lateral slot 404, fluid communication may be provided between first longitudinal hole 402 and first inter-teeth space 209 through first lateral slot 404 and first slot 208*a*.

As further shown in FIG. 1A and FIG. 1B, in an exemplary embodiment, external gear pump 100 may further include a second dead shaft 150. In an exemplary embodiment, second dead shaft 150 may be disposed inside second hole 302. In an exemplary embodiment, second dead shaft 150 may be disposed inside second hole 302 in such a way that driven gear 105 is able to rotate around driven axis 152 without rotation of second dead shaft 150. In an exemplary embodiment, second dead shaft 150 may be fixedly attached to first bearing carrier 102. In an exemplary embodiment, second dead shaft 150 may be fixedly attached to first bearing carrier 102 utilizing a second key 151.

Figure 5A:
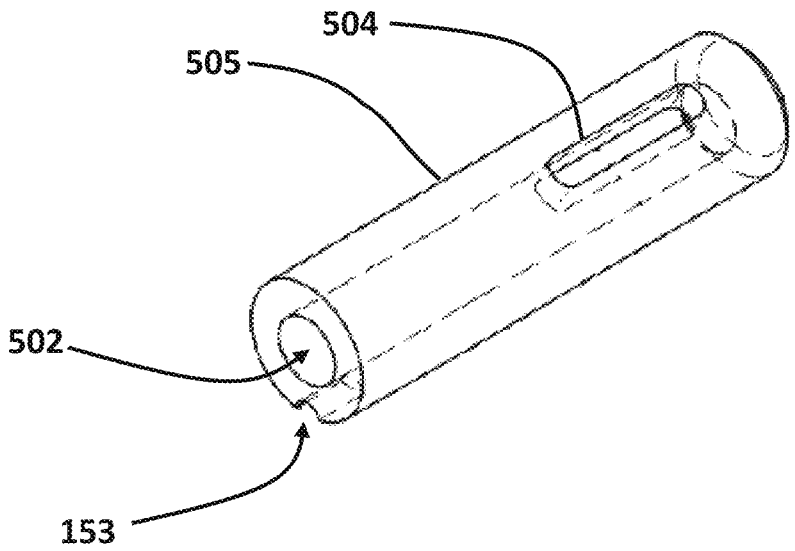
FIG. 5A illustrates a perspective view of a second dead shaft, consistent with one or more exemplary embodiments of the present disclosure.
Figure 5B:
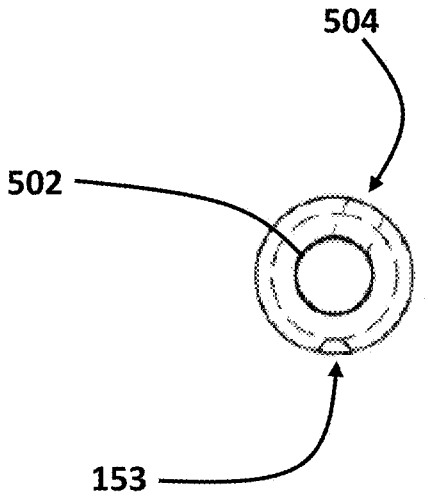
FIG. 5B illustrates a side view of a second dead shaft, consistent with one or more exemplary embodiments of the present disclosure.

FIG. 5A shows a perspective view of second dead shaft 150, consistent with one or more exemplary embodiments of the present disclosure. FIG. 5B shows a side view of second dead shaft 150, consistent with one or more exemplary embodiments of the present disclosure. As shown in FIG. 5A and FIG. 5B, in an exemplary embodiment, second dead shaft 150 may include a third keyway 153. In an exemplary embodiment, first bearing carrier 102 may also include a fourth keyway associated with third keyway 153. In an exemplary embodiment, third keyway 153 and the fourth keyway may be configured to receive second key 151. In an exemplary embodiment, when second key 151 is inserted into third keyway 153 and the fourth keyway, second dead shaft 150 may be fixedly attached to first bearing carrier 102. In an exemplary embodiment, it should be understood that when second dead shaft 150 is fixedly attached to first bearing carrier 102, during rotation of driven gear 104, second dead shaft 150 may remain stationary.

As further shown in FIG. 5A and FIG. 5B, in an exemplary embodiment, second dead shaft 150 may further include a second longitudinal hole 502, and a second lateral slot 504 on a second lateral face 505. In an exemplary embodiment, second lateral slot 504 may be configured to provide fluid communication between second longitudinal hole 502 and an outer space of second dead shaft 150. In an exemplary embodiment, during rotation of driven gear 105, when a respective slot from second plurality of slots 308 is aligned with second lateral slot 504, fluid communication may be provided between second longitudinal hole 502 and a respective inter-teeth space of driven gear 105 through the respective slot and second lateral slot 504. For example, during rotation of driven gear 105, when second slot 308*a* from second plurality of slots 308 is aligned with second lateral slot 504, fluid communication may be provided between second longitudinal hole 502 and second inter-teeth space 309 through second lateral slot 504 and second slot 308*a*.

As further shown in FIG. 1A, in an exemplary embodiment, external gear pump 100 may further include an inlet port 107 at a third side 1016 of external gear pump 100 and connected to the inlet zone 109 and an outlet port 108 at a fourth side 1018 of external gear pump 100 and connected to the outlet zone 110. In an exemplary embodiment, fourth side 1018 of external gear pump 100 may be opposite to third side 1016 of external gear pump 100. In an exemplary embodiment, driver gear 104 and driven gear 105 may be configured to suck a fluid from inlet port 107 at a low pressure. In an exemplary embodiment, driver gear 104 and driven gear 105 may also be configured to pump the fluid to outlet port 108 at a high pressure.

Figure 6:
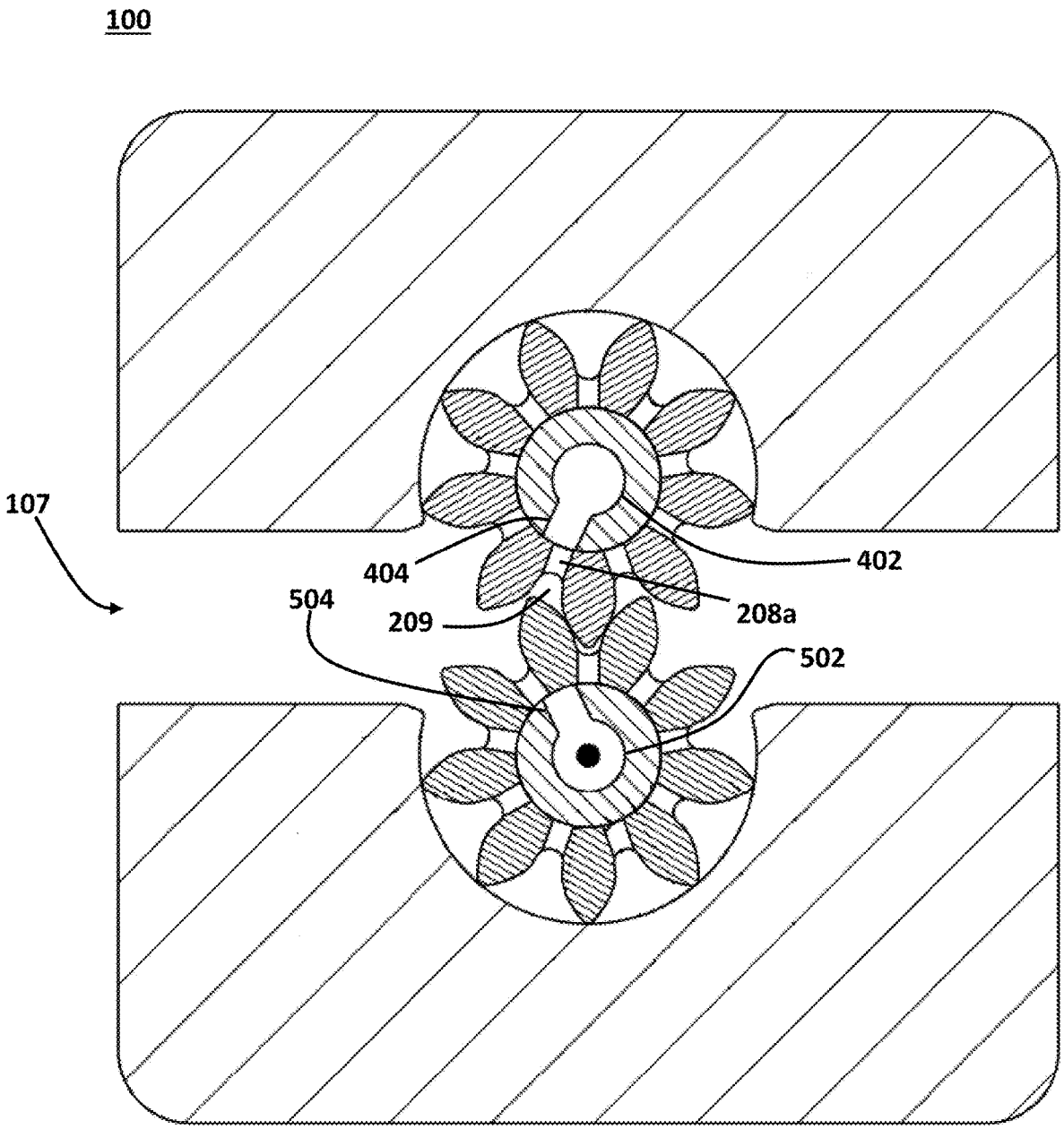
FIG. 6 illustrates a section side view of an external gear pump, consistent with one or more exemplary embodiments of the present disclosure.

FIG. 6 shows a section side view of external gear pump 100, consistent with one or more exemplary embodiments of the present disclosure. As shown in FIG. 6, in an exemplary embodiment, first lateral slot 404 may be provided on first dead shaft 140 in such a way that first lateral slot 404 faces toward driven gear 105 and inlet port 107. In an exemplary embodiment, first longitudinal hole 402 may be in fluid communication with inlet port 107 through a first hose. Furthermore, in an exemplary embodiment, second lateral slot 504 may be provided on second dead shaft 150 in such a way that second lateral slot 504 faces toward driver gear 104 and inlet port 107. In an exemplary embodiment, second longitudinal hole 502 may be in fluid communication with inlet port 107 through a second hose.

Figure 7:
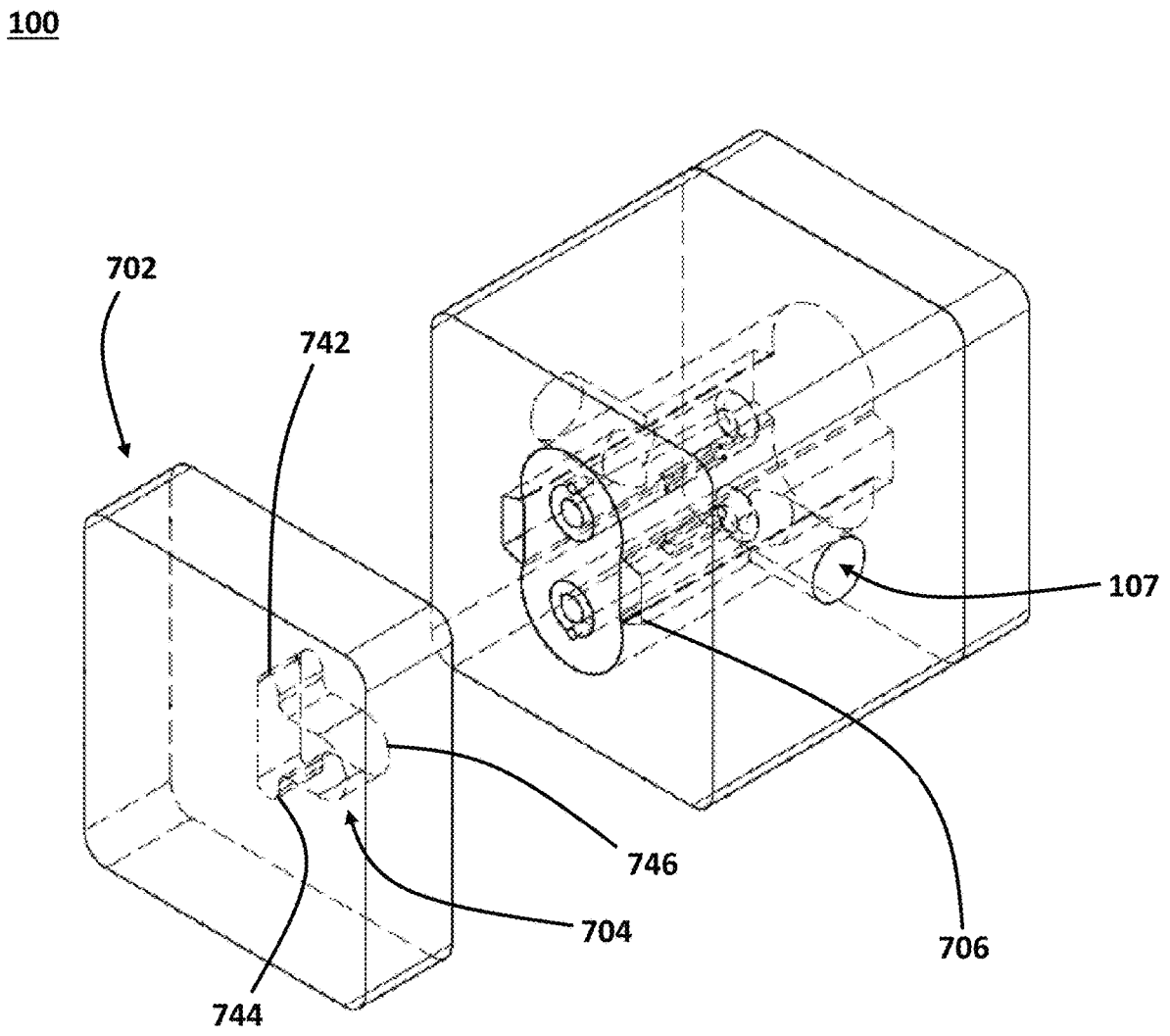
FIG. 7 illustrates a perspective view of an external gear pump, consistent with one or more exemplary embodiments of the present disclosure.

FIG. 7 shows a perspective view of external gear pump 100, consistent with one or more exemplary embodiments of the present disclosure. As shown in FIG. 7, in an exemplary embodiment, external gear pump 100 may include a rear cover 702 configured to be attached to first side 1012 of casing 101. In an exemplary embodiment, rear cover 702 may include a groove path 704. In an exemplary embodiment, groove path 704 may include a first recession 742, a second recession 744, and a third recession 746. In an exemplary embodiment, first recession 742, second recession 744, and third recession 746 may be in fluid communication with each other. In an exemplary embodiment, first recession 742 may be directly connected to first longitudinal hole 402. In an exemplary embodiment, second recession 744 may be directly connected to second longitudinal hole 502. In an exemplary embodiment, third recession 746 may be in fluid communication with inlet port 107 through a first channel 706. Therefore, in an exemplary embodiment, first longitudinal hole 402 and second longitudinal hole 502 may be in fluid communication with inlet port 107.

In an exemplary embodiment, utilizing external gear pump 100 may provide significant benefits. For example, during rotation of driver gear 104 and driven gear 105, fluid may be sucked directly from inlet port 107 into an exemplary inter-teeth space such as first inter-teeth space 209. As first inter-teeth space 209 is in fluid communication with inlet port 107 thorough first longitudinal hole 402 as discussed above, fluid may also be sucked into first inter-teeth space 209 from first longitudinal hole 402. Hence, the cavitation and fluid starvation may be decreased in first inter-teeth space 209 which may lead to a higher volumetric efficiency of external gear pump 100.

Figure 8:
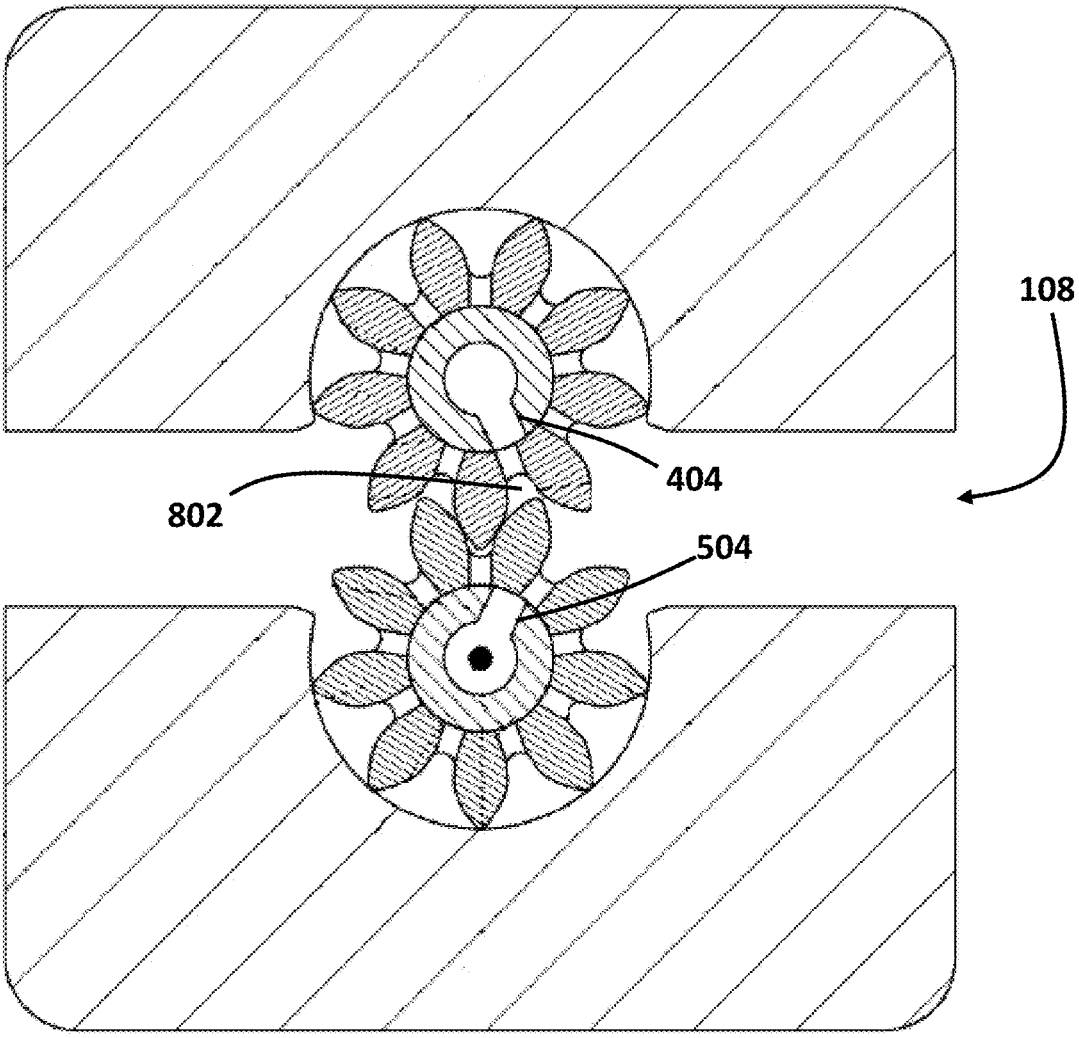
FIG. 8 illustrates a section side view of an external gear pump, consistent with one or more exemplary embodiments of the present disclosure.

FIG. 8 shows a section side view of an external gear pump 800, consistent with one or more exemplary embodiments of the present disclosure. In an exemplary embodiment, external gear pump 800 may be substantially similar to external gear pump 100 but with some differences. In an exemplary embodiment, in external gear pump 800, first lateral slot 404 may face toward driven gear 105 and outlet port 108. Also, second lateral slot 504 may face toward driver gear 104 and outlet port 108. Furthermore, first longitudinal 404 and second longitudinal 504 may be in fluid communication with outlet port 108. In an exemplary embodiment, first longitudinal 404 and second longitudinal 504 may be in fluid communication with outlet port 108 by using a couple of hoses or tubes. In an exemplary embodiment, utilizing external gear pump 800 may provide significant benefits. For example, during rotation of driver gear 104 and driven gear 105, fluid may be pumped to outlet port 108 from an exemplary inter-teeth space such as fourth inter-teeth space 802. As fourth inter-teeth space 802 is in fluid communication with outlet port 107 thorough first longitudinal hole 402, fluid may also be pumped from fourth inter-teeth space 802 into first longitudinal hole 402 and then to outlet port 108. Hence, the fluid congestion and pressure pulsation may be decreased which may lead to a higher isentropic efficiency of external gear pump 800.

Figure 9:
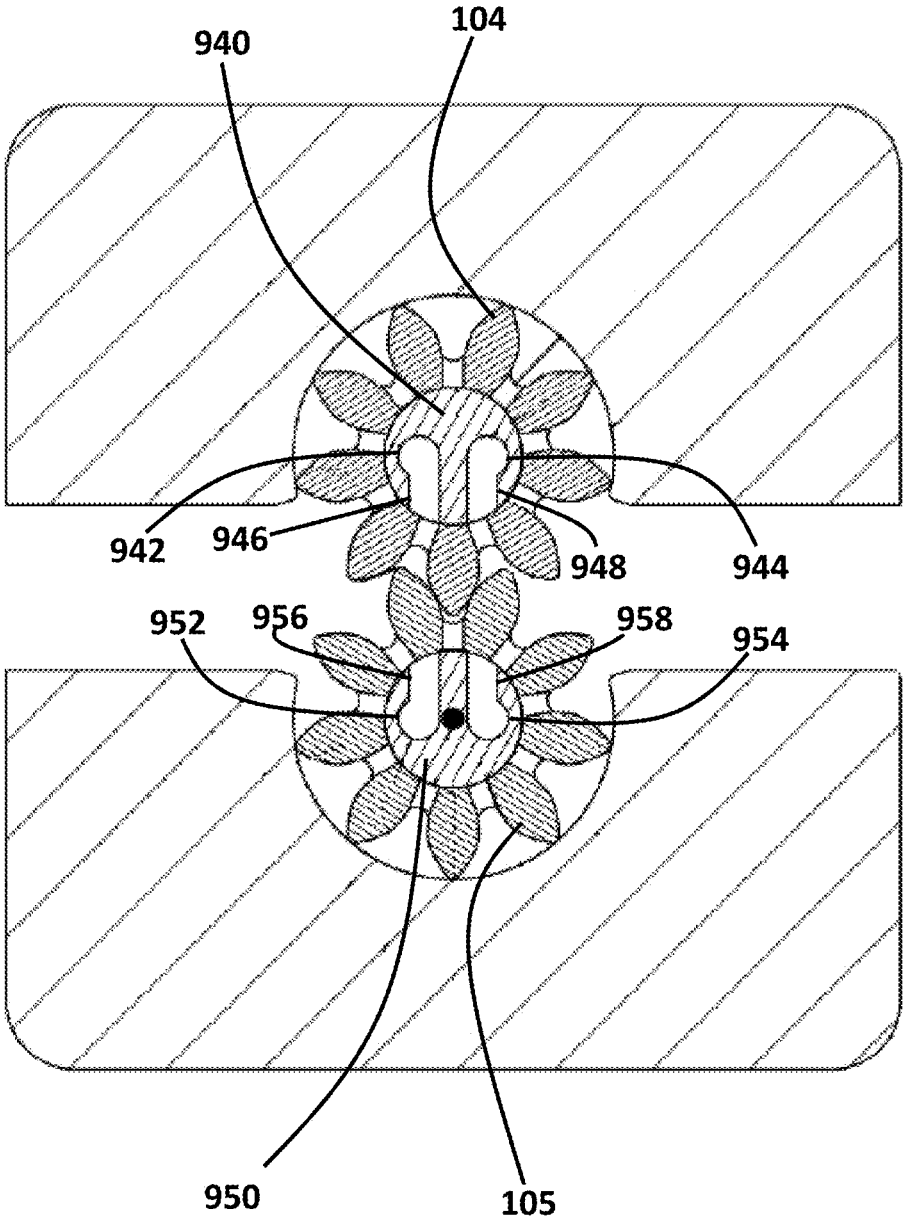
FIG. 9 illustrates a section side view of an external gear pump, consistent with one or more exemplary embodiments of the present disclosure.
Figure 10:
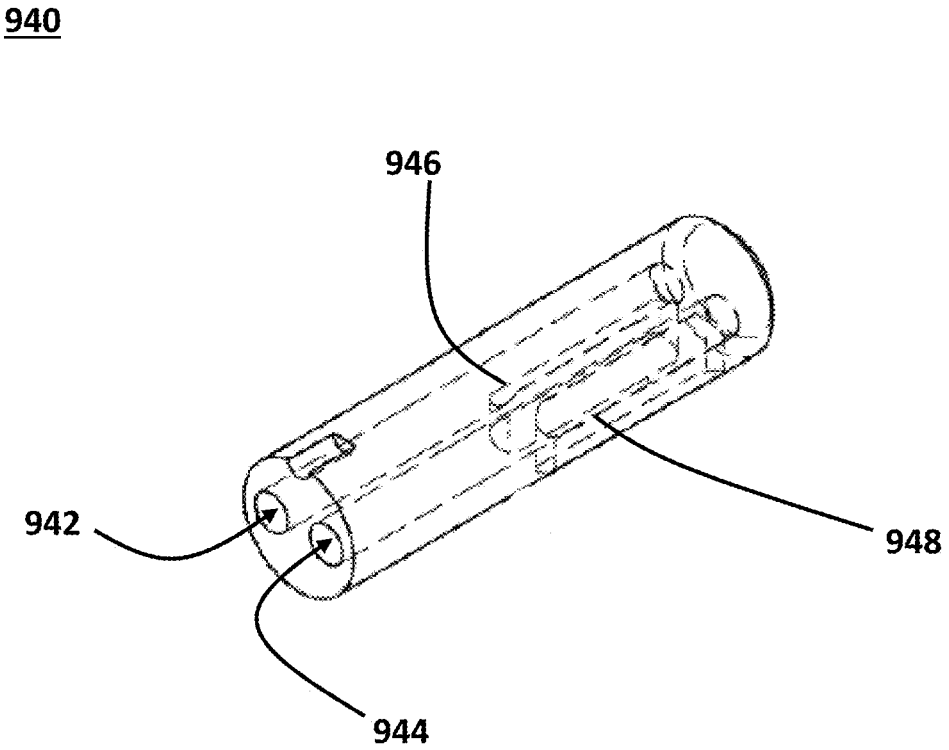
FIG. 10 illustrates a perspective view of a first dead shaft, consistent with one or more exemplary embodiments of the present disclosure.
Figure 11:
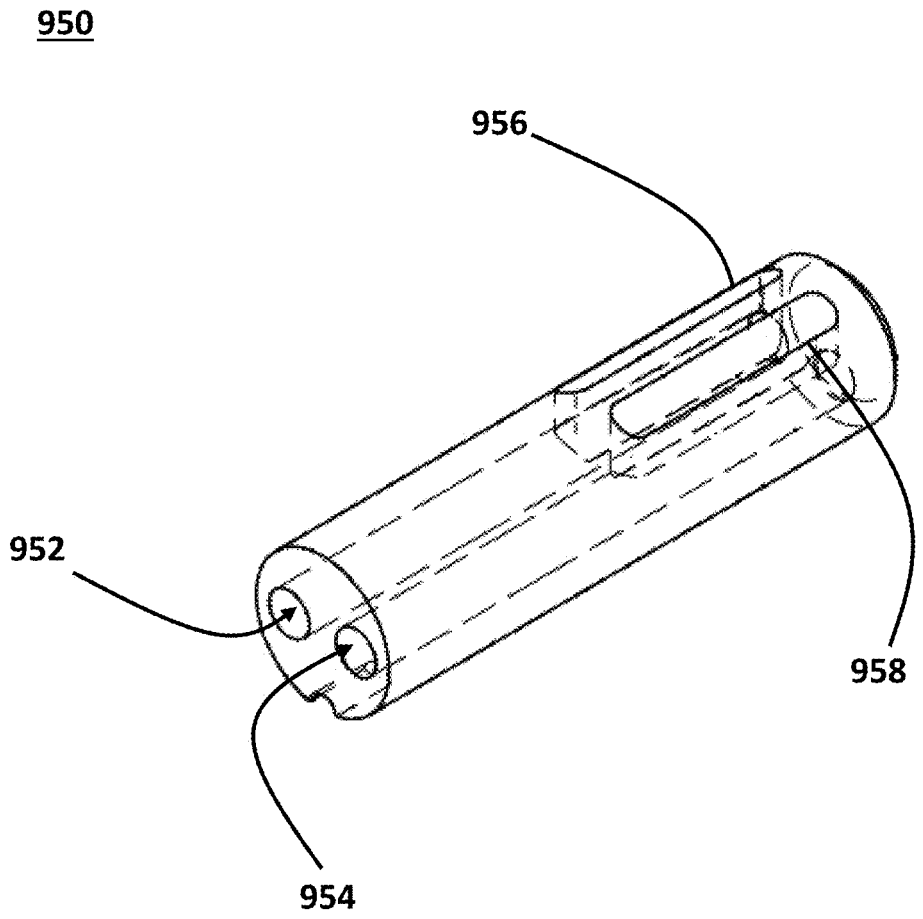
FIG. 11 illustrates a perspective view of a second dead shaft, consistent with one or more exemplary embodiments of the present disclosure.

FIG. 9 shows a section side view of an external gear pump 900, consistent with one or more exemplary embodiments of the present disclosure. In an exemplary embodiment, external gear pump 900 may include a driver gear 104 and a driven gear 105. In an exemplary embodiment, external gear pump 900 may include a first dead shaft 940 and a second dead shaft 950. In an exemplary embodiment, first dead shaft 940 may be disposed inside first hole 202. In an exemplary embodiment, first dead shaft 940 may be disposed inside first hole 202 in such a way that driver gear 104 is able to rotate around driver axis 142 without rotation of first dead shaft 940. In an exemplary embodiment, first dead shaft 940 may be fixedly attached to first bearing carrier 102. In an exemplary embodiment, first dead shaft 940 may be fixedly attached to first bearing carrier 102 utilizing a key mechanism. FIG. 10 shows a perspective view of first dead shaft 940, consistent with one or more exemplary embodiments of the present disclosure. In an exemplary embodiment, second dead shaft 950 may be disposed inside second hole 302. In an exemplary embodiment, second dead shaft 950 may be disposed inside second hole 302 in such a way that driven gear 105 is able to rotate around driven axis 152 without rotation of second dead shaft 950. In an exemplary embodiment, second dead shaft 950 may be fixedly attached to first bearing carrier 102. In an exemplary embodiment, second dead shaft 950 may be fixedly attached to first bearing carrier 102 utilizing a key mechanism. FIG. 11 shows a perspective view of second dead shaft 950, consistent with one or more exemplary embodiments of the present disclosure.

As shown in FIG. 10, in an exemplary embodiment, first dead shaft 940 may include a first longitudinal hole 942 and a first lateral slot 946. In an exemplary embodiment, first lateral slot 946 may be configured to provide fluid communication between first longitudinal hole 942 and an outer space of first dead shaft 940. In an exemplary embodiment, during rotation of driver gear 104, when a respective slot from first plurality of slots 208 is aligned with first lateral slot 946, fluid communication may be provided between first longitudinal hole 942 and a respective inter-teeth space of driver gear 104 through the respective slot and first lateral slot 946. For example, during rotation of driver gear 104, when first slot 208*a* from first plurality of slots 208 is aligned with first lateral slot 946, fluid communication may be provided between first longitudinal hole 942 and first inter-teeth space 209 through first lateral slot 946 and first slot 208*a*.

In an exemplary embodiment, first dead shaft 940 may also include a second longitudinal hole 944 and a second lateral slot 948. In an exemplary embodiment, second lateral slot 948 may be configured to provide fluid communication between second longitudinal hole 944 and an outer space of first dead shaft 940. In an exemplary embodiment, during rotation of driver gear 104, when a respective slot from first plurality of slots 208 is aligned with second lateral slot 948, fluid communication may be provided between second longitudinal hole 944 and a respective inter-teeth space of driver gear 104 through the respective slot and second lateral slot 948. For example, during rotation of driver gear 104, when third slot 208*b* from first plurality of slots 208 is aligned with second lateral slot 948, fluid communication may be provided between second longitudinal hole 944 and third inter-teeth space 210 through second lateral slot 948 and third slot 208*b*.

As shown in FIG. 11, in an exemplary embodiment, second dead shaft 950 may include a third longitudinal hole 952 and a third lateral slot 956. In an exemplary embodiment, third lateral slot 956 may be configured to provide fluid communication between third longitudinal hole 952 and an outer space of second dead shaft 950. In an exemplary embodiment, during rotation of driven gear 105, when a respective slot from second plurality of slots 308 is aligned with third lateral slot 956, fluid communication may be provided between third longitudinal hole 952 and a respective inter-teeth space of driven gear 105 through the respective slot and third lateral slot 956.

In an exemplary embodiment, second dead shaft 950 may also include a fourth longitudinal hole 954 and a fourth lateral slot 958. In an exemplary embodiment, fourth lateral slot 958 may be configured to provide fluid communication between fourth longitudinal hole 954 and an outer space of second dead shaft 950. In an exemplary embodiment, during rotation of driven gear 105, when a respective slot from second plurality of slots 308 is aligned with fourth lateral slot 958, fluid communication may be provided between fourth longitudinal hole 954 and a respective inter-teeth space of driven gear 105 through the respective slot and fourth lateral slot 958.

Figure 12:
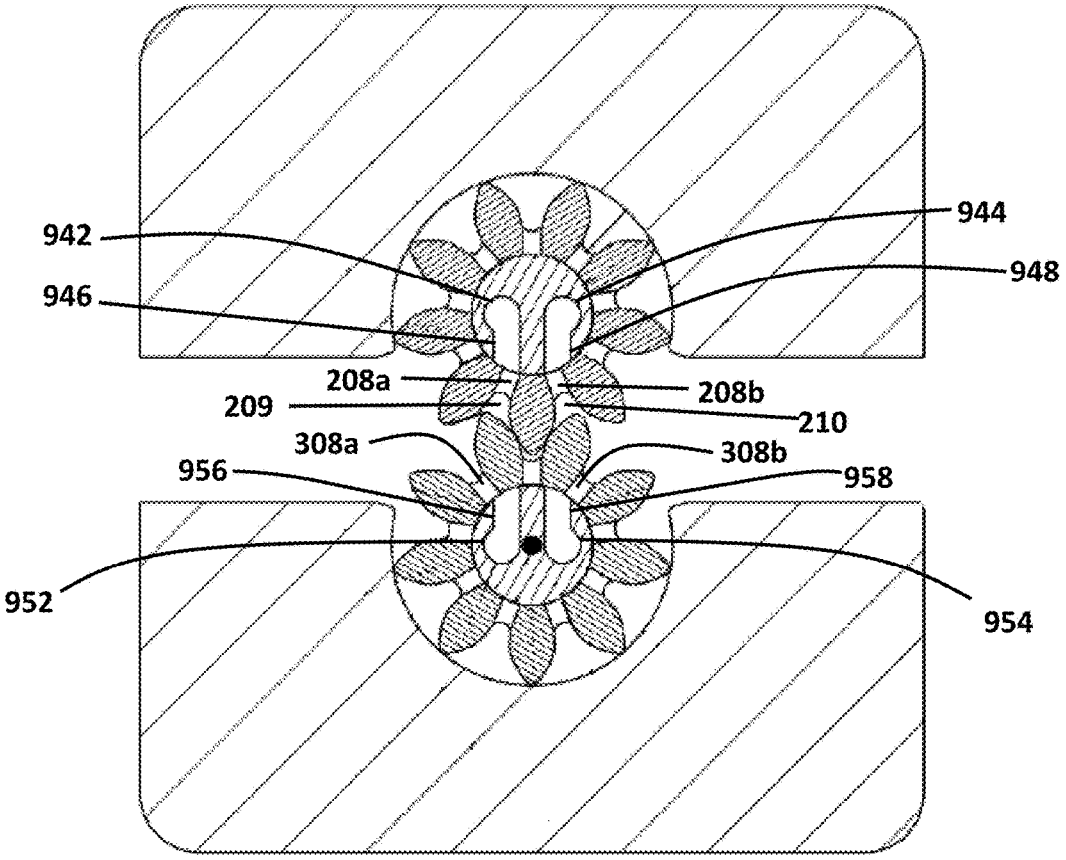
FIG. 12 illustrates a section side view of an external gear pump, consistent with one or more exemplary embodiments of the present disclosure.

FIG. 12 shows a section side view of external gear pump 900, consistent with one or more exemplary embodiments of the present disclosure. As shown in FIG. 12, in an exemplary embodiment, first lateral slot 946 may be provided on first dead shaft 940 in such a way that first lateral slot 946 faces toward driven gear 105 and inlet port 107. In an exemplary embodiment, first lateral slot 946 may be in fluid communication with inlet port 107 through a third hose. Furthermore, in an exemplary embodiment, third lateral slot 956 may be provided on second dead shaft 950 in such a way that third lateral slot 956 faces toward driver gear 104 and inlet port 107. In an exemplary embodiment, third longitudinal hole 952 may be in fluid communication with inlet port 107. In an exemplary embodiment, second lateral slot 948 may be provided on first dead shaft 940 in such a way that second lateral slot 948 faces toward driven gear 105 and outlet port 108. In an exemplary embodiment, second lateral slot 948 may be in fluid communication with outlet port 108. Furthermore, in an exemplary embodiment, fourth lateral slot 958 may be provided on second dead shaft 950 in such a way that fourth lateral slot 958 faces toward driver gear 104 and outlet port 108. In an exemplary embodiment, fourth longitudinal hole 954 may be in fluid communication with outlet port 108. In an exemplary embodiment, first longitudinal hole 942 and third longitudinal hole 952 may be in fluid communication inlet port 107 by utilizing a pipeline system. In an exemplary embodiment, second longitudinal hole 944 and fourth longitudinal hole 954 may also be in fluid communication outlet port 108 by utilizing a pipeline system.

Figure 13:
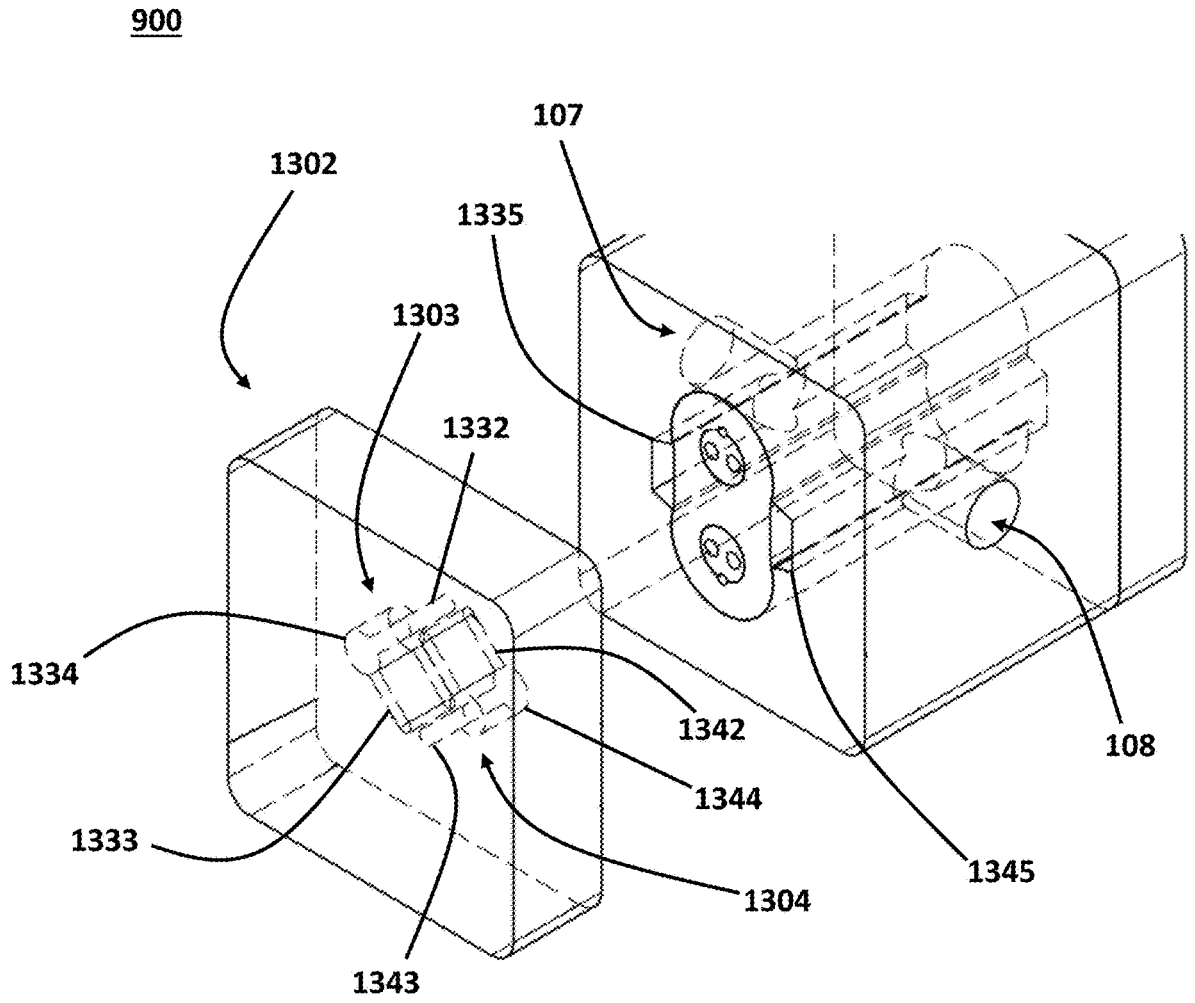
FIG. 13 illustrates a perspective view of an external gear pump, consistent with one or more exemplary embodiments of the present disclosure.
Figure 14:
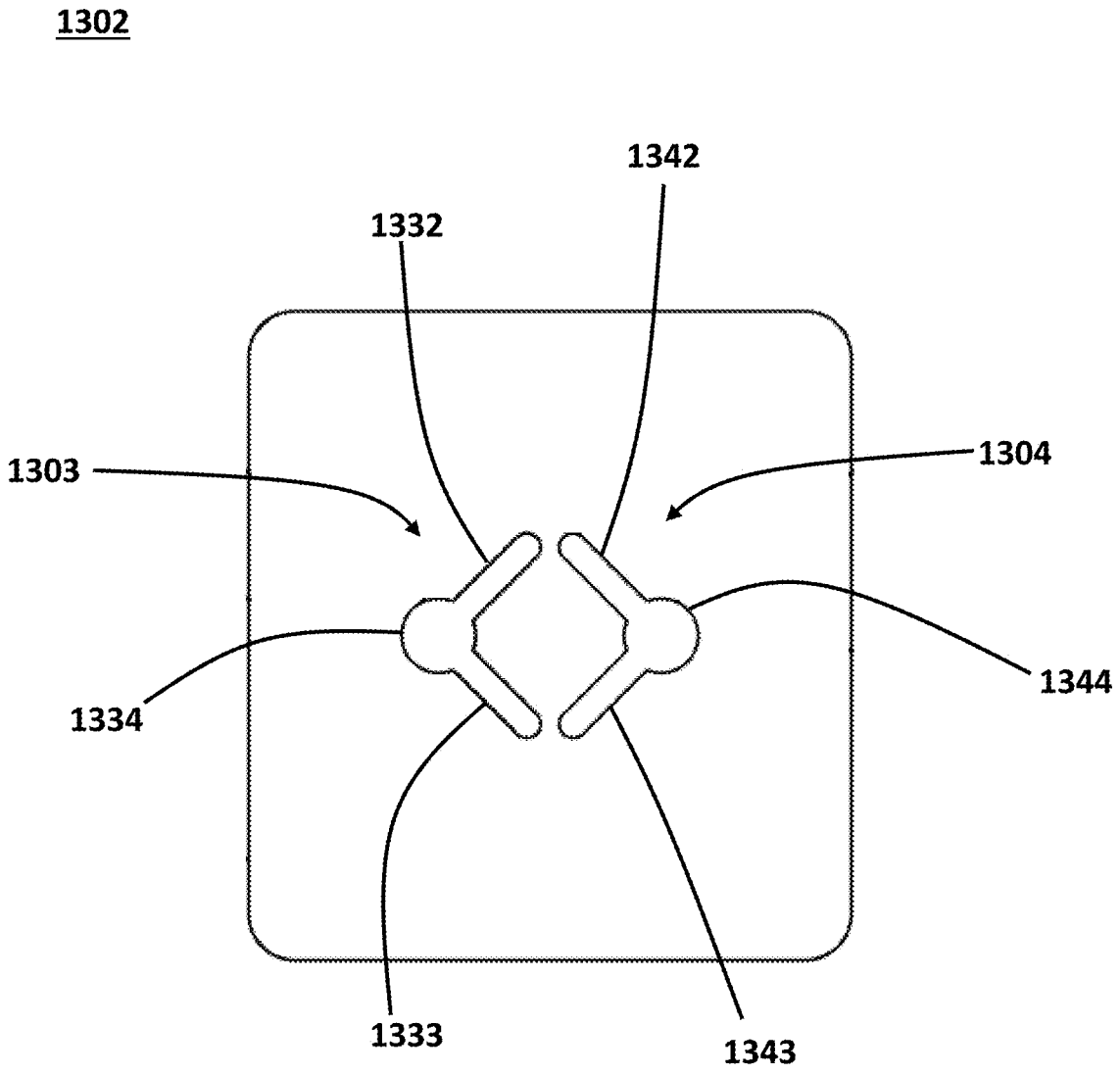
FIG. 14 illustrates a section side view of a rear cover, consistent with one or more exemplary embodiments of the present disclosure.

FIG. 13 shows a perspective view of external gear pump 900, consistent with one or more exemplary embodiments of the present disclosure. FIG. 14 shows a section side view of a rear cover, consistent with one or more exemplary embodiments of the present disclosure. As shown in FIG. 13 and FIG. 14, in an exemplary embodiment, external gear pump 900 may include a rear cover 1302. In an exemplary embodiment, rear cover 1302 may be configured to be attached to first side 1012 of casing 101. In an exemplary embodiment, rear cover 1302 may include a first groove path 1303 and a second groove path 1304. In an exemplary embodiment, first groove path 1303 may be configured to provide fluid communication between first longitudinal hole 942 and inlet port 107. In an exemplary embodiment, first groove path 1303 may further be configured to provide fluid communication between third longitudinal hole 952 and inlet port 107. In an exemplary embodiment, second groove path 1304 may be configured to provide fluid communication between second longitudinal hole 944 and outlet port 108. In an exemplary embodiment, second groove path 1304 may further be configured to provide fluid communication between fourth longitudinal hole 954 and outlet port 108.

In an exemplary embodiment, first groove path 1303 may include a first recession 1332, a third recession 1333, and a first connection recession 1334. In an exemplary embodiment, first recession 1332 may be directly connected to first longitudinal hole 942. In an exemplary embodiment, third recession 1333 may be directly connected to third longitudinal hole 952. In an exemplary embodiment, first connection recession may be in fluid communication with inlet port 107 through a first channel 1335. In an exemplary embodiment, second groove path 1304 may include a second recession 1342, a fourth recession 1343, and a second connection recession 1344. In an exemplary embodiment, second recession 1342 may be directly connected to second longitudinal hole 944. In an exemplary embodiment, fourth recession 1343 may be directly connected to fourth longitudinal hole 954. In an exemplary embodiment, second connection recession may be in fluid communication with outlet port 108 through a second channel 1345. In an exemplary embodiment, utilizing external gear pump 900 may provide benefits of both external gear pump 100 and external gear pump 800. In an exemplary embodiment, as discussed above, by utilizing external gear pump 900, the cavitation and fluid starvation may be decreased in respective inter-teeth space which may lead to a higher volumetric efficiency of external gear pump 900 and also fluid congestion and pressure pulsation may be decreased which may lead to a higher isentropic efficiency of external gear pump 900.

Figure 15A:
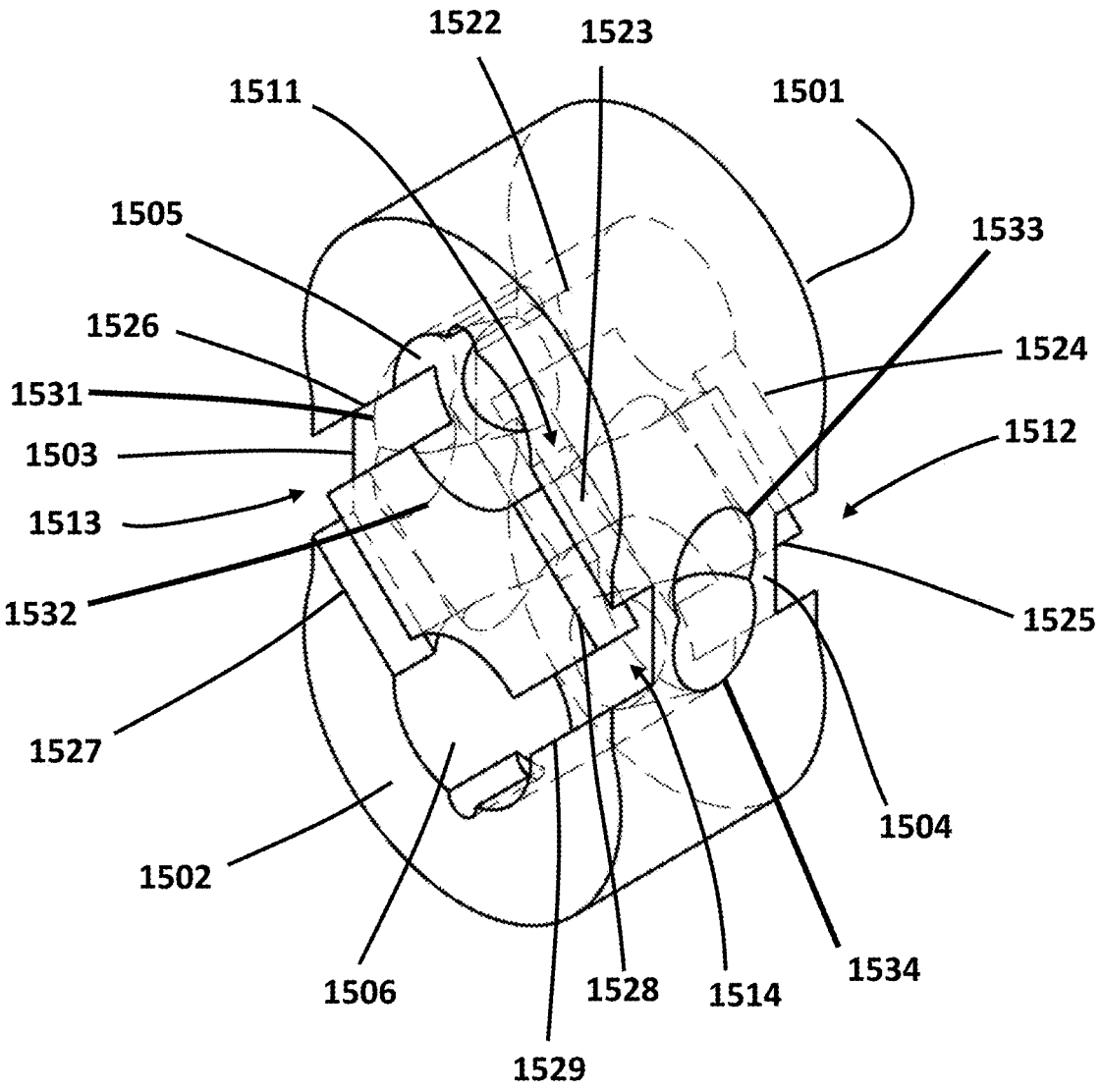
FIG. 15A illustrates a perspective view of a first bearing carrier, consistent with one or more exemplary embodiments of the present disclosure.

FIG. 15A illustrates a perspective view of the first bearing carrier 102, consistent with one or more exemplary embodiments of the present disclosure. The first bearing carrier 102 is configured to support the driver and driven gears within the external gear pump, facilitating the reduction of cavitation and pressure pulsation, especially in high-speed pumping applications.

The first bearing carrier 102 includes a fifth face 1501 and a sixth face 1502, each featuring respective groove paths designed to enhance fluid communication within the pump. Specifically, the fifth face 1501 is provided with a third groove path 1511 and a fourth groove path 1512. These groove paths contain recessions that extend from the internal holes (third hole 1505 and fourth hole 1506) to the periphery of the lateral faces (third lateral face 1503 and fourth lateral face 1504) of the bearing carrier. This configuration aids in mitigating fluid congestion and pressure pulsations by ensuring consistent fluid flow across the meshing zone of the gears.

The third groove path 1511 includes a seventh recession 1522 and an eighth recession 1523, while the fourth groove path 1512 includes a ninth recession 1524 and a tenth recession 1525. These recessions ensure fluid communication from the third hole 1505 and the fourth hole 1506, respectively, to the periphery of the associated lateral faces, optimizing the fluid flow within the pump.

Figure 15B:
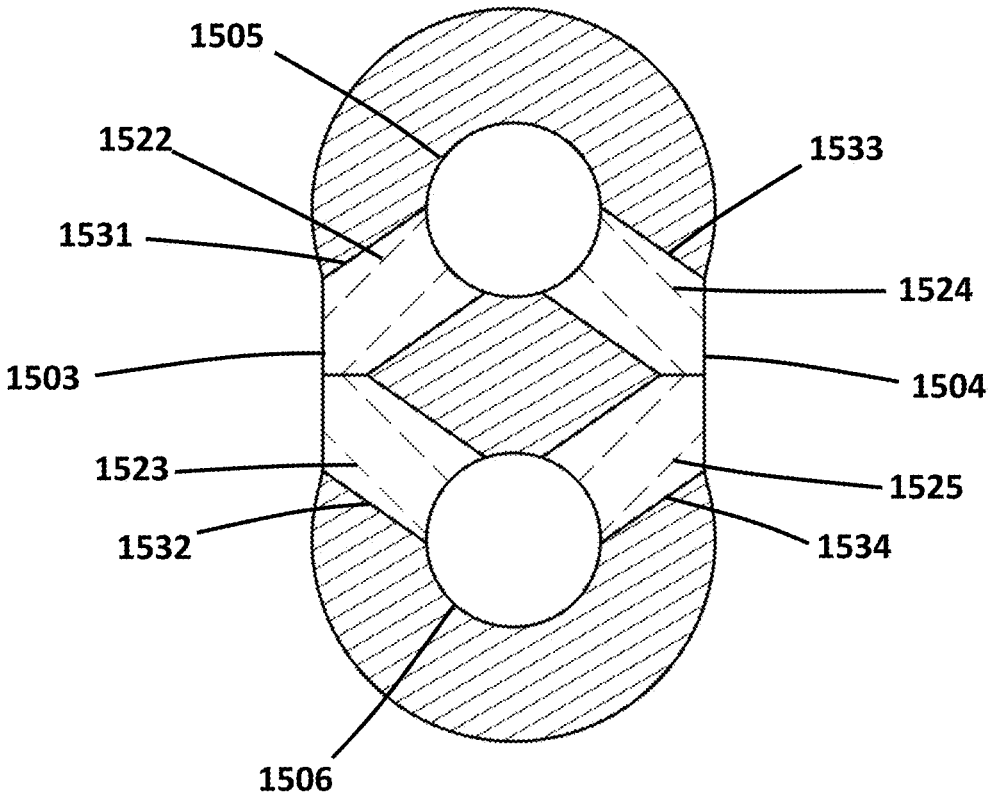
FIG. 15B illustrates a section side view of a first bearing carrier, consistent with one or more exemplary embodiments of the present disclosure.

FIG. 15B presents a sectional side view of the first bearing carrier 102, further detailing the internal structure that supports fluid communication between the key components of the gear pump. In addition to the third and fourth groove paths, the fifth face 1501 of the first bearing carrier 102 includes a fifth groove path 1513 and a sixth groove path 1514 on the sixth face 1502. Each groove path comprises recessions that mirror those on the opposing face, facilitating smoother fluid flow within the pump.

In one exemplary embodiment, the fifth groove path 1513, being connected to the third lateral face 1503, consists of an eleventh recession 1526 and a twelfth recession 1527, while the sixth groove path 1514, being connected to the fourth lateral face 1504, includes a thirteenth recession 1528 and a fourteenth recession 1529. In one exemplary embodiment, the fifth groove path 1513 and the sixth groove path 1514 are located on the sixth face of the first bearing carrier, while being connected to the third and fourth lateral faces, respectively. These recessions maintain fluid communication between the third and fourth holes and the periphery of the corresponding lateral faces, contributing to the overall efficiency and stability of the gear pump during operation.

Further enhancing fluid management, the first bearing carrier 102 features additional lateral slots on both the third lateral face 1503 and the fourth lateral face 1504. Specifically, a fifth lateral slot 1531 and a sixth lateral slot 1532 on the third lateral face 1503, along with a seventh lateral slot 1533 and an eighth lateral slot 1534 on the fourth lateral face 1504, provide direct fluid pathways from the internal holes to the periphery, reinforcing the carrier's role in reducing cavitation and pressure pulsation.

Figure 16:
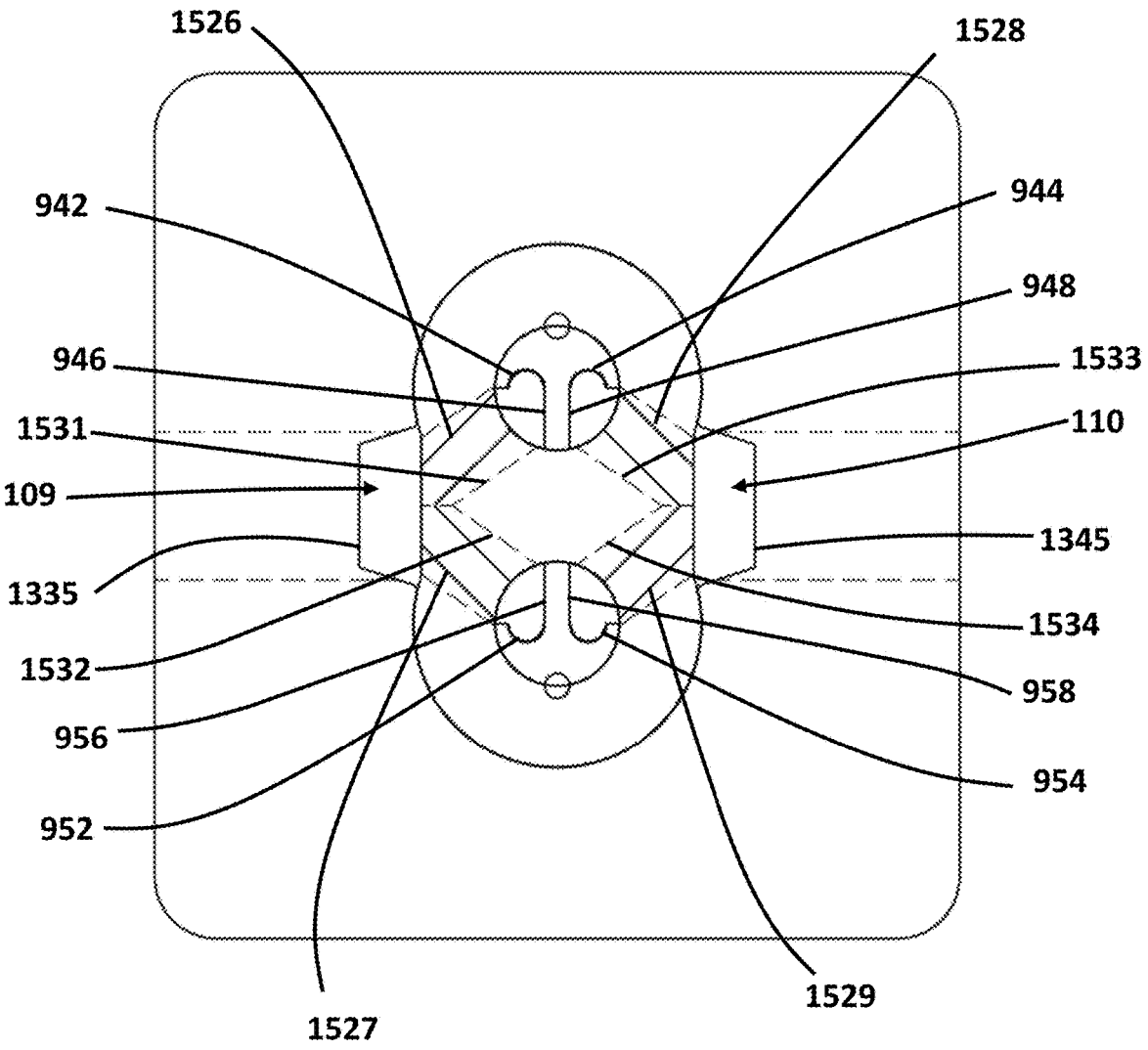
FIG. 16 illustrates a side view of an external gear pump, consistent with one or more exemplary embodiments of the present disclosure.

FIG. 16 illustrates a side view of an external gear pump 900, consistent with one or more exemplary embodiments of the present disclosure. In this embodiment, the external gear pump 900 may include a fluid connection system designed to optimize fluid communication between various internal components, thereby enhancing the pump's efficiency and reducing cavitation and pressure pulsations.

The fluid connection begins with the first longitudinal hole 942 and the first lateral slot 946. Fluid may be directed from these components through the seventh recession 1522, into the first channel 1335, and subsequently into the inlet zone 109. Similarly, fluid communication may be established from the second longitudinal hole 952 and the second lateral slot 956 through the eighth recession 1523, continuing through the first channel 1335, and into the inlet zone 109.

Additionally, fluid is conveyed from the first longitudinal hole 942 and the first lateral slot 946 through the eleventh recession 1526, into the first channel 1335, and finally to the inlet zone 109. The second longitudinal hole 952 and the second lateral slot 956 also facilitate fluid flow through the twelfth recession 1527, leading to the first channel 1335 and into the inlet zone 109.

Further, fluid communication may being provided from the first longitudinal hole 942 and the first lateral slot 946 through the fifth lateral slot 1531, directing fluid to the first channel 1335 and subsequently into the inlet zone 109. In a similar manner, the second longitudinal hole 952 and the second lateral slot 956 channel fluid through the sixth lateral slot 1532 into the first channel 1335 and then to the inlet zone 109.

On the outlet side, fluid connection is provided from the third longitudinal hole 944 and the third lateral slot 948 through the ninth recession 1524, into the second channel 1345, and into the outlet zone 110. Similarly, fluid is directed from the fourth longitudinal hole 954 and the fourth lateral slot 958 through the tenth recession 1525, continuing into the second channel 1345 and finally into the outlet zone 110.

Moreover, fluid flow from the third longitudinal hole 944 and the third lateral slot 948 is facilitated through the thirteenth recession 1528, into the second channel 1345, and into the outlet zone 110. The fourth longitudinal hole 954 and the fourth lateral slot 958 similarly provide fluid communication through the fourteenth recession 1529, directing fluid into the second channel 1345 and into the outlet zone 110.

Finally, fluid may conveyed from the third longitudinal hole 944 and the third lateral slot 948 through the seventh lateral slot 1533 into the second channel 1345 and then into the outlet zone 110. Likewise, the fourth longitudinal hole 954 and the fourth lateral slot 958 channel fluid through the eighth lateral slot 1534, leading to the second channel 1345 and into the outlet zone 110.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective spaces of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. An external gear pump, comprising:

a casing with an inlet and an outlet;

a driver gear supported for rotation within the casing, disposed between the outlet and the inlet, and configured to rotate around a driver axis in a first rotational direction;

a driven gear supported for rotation within the casing, disposed between the outlet and the inlet, and configured to rotate around a driven axis in a second rotational direction opposite to the first rotational direction, and meshing with the driver gear in a mesh zone;

a first bearing carrier disposed in the casing at a first side of the casing;

a second bearing carrier disposed in the casing at a second side of the casing, opposite to the first side of the casing, the first bearing carrier further comprising a third hole and a fourth hole;

porting passageways disposed within the first bearing carrier;

a front cover attached to the second side of the casing;

a rear cover attached to the first side of the casing, the rear cover comprising porting passageways;

wherein the driver gear further comprises:

a first face and a second face;

a first hole extending inward from the second face;

a first live shaft extending outward from the second face;

a first plurality of teeth and a first plurality of root surfaces arranged alternately around the driver gear;

a first plurality of slots provided on the first plurality of root surfaces, each slot configured to provide fluid communication between the first hole and a respective first inter-teeth space between two consecutive teeth from the first plurality of teeth;

wherein the driven gear further comprises:

a third face and a fourth face;

a second hole extending inward from the third face;

a second live shaft extending outward from the fourth face;

a second plurality of teeth and a second plurality of root surfaces arranged alternately around the driven gear;

a second plurality of slots provided on the second plurality of root surfaces, each slot configured to provide fluid communication between the second hole and a respective second inter-teeth space between two consecutive teeth from the second plurality of teeth;

a first dead shaft disposed inside the first hole of the driver gear and the third hole of the first bearing carrier, fixedly attached to the first bearing carrier, the first dead shaft comprising:

a first longitudinal hole;

a first lateral slot on a first lateral face of the first dead shaft, configured to provide fluid communication between the first longitudinal hole and the first lateral slot;

a third longitudinal hole;

a third lateral slot on the first lateral face of the first dead shaft, configured to provide fluid communication between the third longitudinal hole and the third lateral slot;

a second dead shaft disposed inside the second hole of the driven gear and the fourth hole of the first bearing carrier, fixedly attached to the first bearing carrier, the second dead shaft comprising:

a second longitudinal hole;

a second lateral slot on a second lateral face of the second dead shaft, configured to provide fluid communication between the second longitudinal hole and the second lateral slot;

a fourth longitudinal hole;

a fourth lateral slot on the second lateral face of the second dead shaft, configured to provide fluid communication between the fourth longitudinal hole and the fourth lateral slot;

an inlet port at a third side of the casing, in fluid communication with an inlet zone disposed within the third side of the casing, the driver gear and the driven gear configured to suck fluid from the inlet port at the inlet zone;

an outlet port at a fourth side of the casing, in fluid communication with an outlet zone disposed within the fourth side of the casing, the driver gear and the driven gear configured to expel the fluid to the outlet port at the outlet zone;

wherein:

the first lateral slot faces the inlet zone;

the second lateral slot faces the inlet zone;

the third lateral slot faces the outlet zone;

the fourth lateral slot faces the outlet zone;

the first longitudinal hole and the first lateral slot are in fluid communication with the inlet zone;

the second longitudinal hole and the second lateral slot are in fluid communication with the inlet zone;

the third longitudinal hole and the third lateral slot are in fluid communication with the outlet zone;

the fourth longitudinal hole and the fourth lateral slot are in fluid communication with the outlet zone;

wherein:

when the first lateral slot is aligned with the adjacent slots from the first plurality of slots, fluid communication is provided between the first inter-teeth space and the inlet zone through the first longitudinal hole, the first lateral slot, and the adjacent slots from the first plurality of slots;

when the second lateral slot is aligned with the adjacent slots from the second plurality of slots, fluid communication is provided between the second inter-teeth space and the inlet zone through the second longitudinal hole, the second lateral slot, and the adjacent slots from the second plurality of slots;

when the third lateral slot is aligned with the adjacent slots from the first plurality of slots, fluid communication is provided between the first inter-teeth space and the outlet zone through the third longitudinal hole, the third lateral slot, and the adjacent slots from the first plurality of slots;

when the fourth lateral slot is aligned with the adjacent slots from the second plurality of slots, fluid communication is provided between the second inter-teeth space and the outlet zone through the fourth longitudinal hole, the fourth lateral slot, and the adjacent slots from the second plurality of slots.

2. The external gear pump of claim 1, wherein:

the rear cover comprises porting passageways;

the rear cover comprises a first groove path configured to:

provide fluid communication between the first longitudinal hole, the first lateral slot, and the inlet port;

provide fluid communication between the second longitudinal hole, the second lateral slot, and the inlet port;

the rear cover comprises a second groove path configured to:

provide fluid communication between the third longitudinal hole, the third lateral slot, and the outlet port;

provide fluid communication between the fourth longitudinal hole, the fourth lateral slot, and the outlet port;

the first groove path comprises:

a first recession in fluid communication with the first longitudinal hole and the first lateral slot;

a second recession in fluid communication with the second longitudinal hole and the second lateral slot;

a third recession in fluid communication with the inlet zone through a first channel, with the first recession, second recession, and third recession in fluid communication with each other;

the second groove path comprises:

a fourth recession in fluid communication with the third longitudinal hole and the third lateral slot;

a fifth recession in fluid communication with the fourth longitudinal hole and the fourth lateral slot;

a sixth recession in fluid communication with the outlet zone through a second channel, with the fourth recession, fifth recession, and sixth recession in fluid communication with each other.

3. The external gear pump of claim 1, wherein:

the first bearing carrier further comprises additional porting passageways;

the first bearing carrier further comprises a fifth face, a sixth face, a third lateral face, and a fourth lateral face;

the fifth face on the first bearing carrier comprises a third groove path configured to:

provide fluid communication between the first longitudinal hole, the first lateral slot, and the inlet zone;

provide fluid communication between the second longitudinal hole, the second lateral slot, and the inlet zone;

the fifth face on the first bearing carrier comprises a fourth groove path configured to:

provide fluid communication between the third longitudinal hole, the third lateral slot, and the outlet zone;

provide fluid communication between the fourth longitudinal hole, the fourth lateral slot, and the outlet zone;

the third groove path comprises:

a seventh recession in fluid communication with the first longitudinal hole, the first lateral slot, and the inlet zone;

an eighth recession in fluid communication with the second longitudinal hole, the second lateral slot, and the inlet zone;

the fourth groove path comprises:

a ninth recession in fluid communication with the third longitudinal hole, the third lateral slot, and the outlet zone;

a tenth recession in fluid communication with the fourth longitudinal hole, the fourth lateral slot, and the outlet zone;

the sixth face on the first bearing carrier comprises a fifth groove path configured to:

provide fluid communication between the first longitudinal hole, the first lateral slot, and the inlet zone;

provide fluid communication between the second longitudinal hole, the second lateral slot, and the inlet zone;

the sixth face on the first bearing carrier comprises a sixth groove path configured to:

provide fluid communication between the third longitudinal hole, the third lateral slot, and the outlet zone;

provide fluid communication between the fourth longitudinal hole, the fourth lateral slot, and the outlet zone;

the fifth groove path comprises:

an eleventh recession in fluid communication with the first longitudinal hole, the first lateral slot, and the inlet zone;

a twelfth recession in fluid communication with the second longitudinal hole, the second lateral slot, and the inlet zone;

the sixth groove path comprises:

a thirteenth recession in fluid communication with the third longitudinal hole, the third lateral slot, and the outlet zone;

a fourteenth recession in fluid communication with the fourth longitudinal hole, the fourth lateral slot, and the outlet zone;

the third lateral face of the first bearing carrier, which faces the inlet zone, comprises a fifth lateral slot configured to provide fluid communication between the fifth lateral slot and the third hole of the first bearing carrier;

the third lateral face of the first bearing carrier, which faces the inlet zone, comprises a sixth lateral slot configured to provide fluid communication between the sixth lateral slot and the fourth hole of the first bearing carrier;

wherein the fifth lateral slot and the sixth lateral slot are in fluid communication with the inlet zone through the first channel, the fifth lateral slot, the sixth lateral slot, the first lateral slot, the first longitudinal hole, the second lateral slot, and the second longitudinal hole being in fluid communication with each other;

the fourth lateral face of the first bearing carrier, which faces the outlet zone, comprises a seventh lateral slot configured to provide fluid communication between the seventh lateral slot and the third hole of the first bearing carrier;

the fourth lateral face of the first bearing carrier, which faces the outlet zone, comprises an eighth lateral slot configured to provide fluid communication between the eighth lateral slot and the fourth hole of the first bearing carrier;

wherein the seventh lateral slot and the eighth lateral slot are in fluid communication with the outlet zone through the second channel, the seventh lateral slot, the eighth lateral slot, the third lateral slot, the third longitudinal hole, the fourth lateral slot, and the fourth longitudinal hole being in fluid communication with each other.

4. An external gear pump, comprising:

a casing with an inlet and an outlet;

a driver gear supported for rotation within the casing, disposed between the outlet and the inlet, and configured to rotate around a driver axis in a first rotational direction;

a driven gear supported for rotation within the casing, disposed between the outlet and the inlet, and configured to rotate around a driven axis in a second rotational direction opposite to the first rotational direction, and meshing with the driver gear in a mesh zone;

a first bearing carrier disposed in the casing at a first side of the casing;

a second bearing carrier disposed in the casing at a second side of the casing, opposite to the first side of the casing, the first bearing carrier further comprising a third hole and a fourth hole;

porting passageways disposed within the first bearing carrier;

a rear cover attached to the first side of the casing;

a front cover attached to the second side of the casing;

porting passageways disposed within the rear cover;

wherein the driver gear further comprises:

a first face and a second face;

a first hole extending inward from the first face;

a first live shaft extending outward from the second face;

a first plurality of teeth and a first plurality of root surfaces arranged alternately around the driver gear;

a first plurality of slots provided on the first plurality of root surfaces, each slot configured to provide fluid communication between the first hole and a respective first inter-teeth space between two consecutive teeth from the first plurality of teeth;

wherein the driven gear further comprises:

a third face and a fourth face;

a second hole extending inward from the third face;

a second live shaft extending outward from the fourth face;

a second plurality of teeth and a second plurality of root surfaces arranged alternately around the driven gear;

a second plurality of slots provided on the second plurality of root surfaces, each slot configured to provide fluid communication between the second hole and a respective second inter-teeth space between two consecutive teeth from the second plurality of teeth;

a first dead shaft disposed inside the first hole of the driver gear and the third hole of the first bearing carrier, fixedly attached to the first bearing carrier, the first dead shaft comprising:

a first longitudinal hole; and a first lateral slot on a first lateral face of the first dead shaft, configured to provide fluid communication between the first longitudinal hole and the first lateral slot;

a second dead shaft disposed inside the second hole of the driven gear and the fourth hole of the first bearing carrier, fixedly attached to the first bearing carrier, the second dead shaft comprising:

a second longitudinal hole; and a second lateral slot on a second lateral face of the second dead shaft, configured to provide fluid communication between the second longitudinal hole and the second lateral slot;

an inlet port at a third side of the casing, in fluid communication with an inlet zone disposed within the third side of the casing, the driver gear and the driven gear configured to draw fluid from the inlet port at the inlet zone; and an outlet port at a fourth side of the casing, in fluid communication with an outlet zone disposed within the fourth side of the casing, the driver gear and the driven gear configured to expel fluid to the outlet port at the outlet zone;

wherein:

the first lateral slot faces the inlet zone;

the second lateral slot faces the inlet zone;

the first longitudinal hole and the first lateral slot are in fluid communication with the inlet zone;

the second longitudinal hole and the second lateral slot are in fluid communication with the inlet zone;

when the first lateral slot aligns with the adjacent slots from the first plurality of slots, fluid communication is provided between the first inter-teeth space and the inlet zone through the first longitudinal hole, the first lateral slot, and the adjacent slots from the first plurality of slots; and when the second lateral slot aligns with the adjacent slots from the second plurality of slots, fluid communication is provided between the second inter-teeth space and the inlet zone through the second longitudinal hole, the second lateral slot, and the adjacent slots from the second plurality of slots.

5. The external gear pump of claim 4, wherein:

the rear cover comprises porting passageways;

the rear cover comprises a first groove path configured to:

provide fluid communication between the first longitudinal hole, the first lateral slot, and the inlet port; and provide fluid communication between the second longitudinal hole, the second lateral slot, and the inlet port;

the first groove path comprises:

a first recession in fluid communication with the first longitudinal hole and the first lateral slot;

a second recession in fluid communication with the second longitudinal hole and the second lateral slot;

a third recession in fluid communication with the inlet zone through a first channel, wherein the first recession, the second recession, and the third recession are in fluid communication with each other.

6. The external gear pump of claim 4, wherein:

the first bearing carrier further comprises additional porting passageways;

the first bearing carrier further comprises a fifth face, a sixth face, and a third lateral face;

the fifth face of the first bearing carrier comprises a second groove path configured to:

provide fluid communication between the first longitudinal hole, the first lateral slot, and the inlet zone; and provide fluid communication between the second longitudinal hole, the second lateral slot, and the inlet zone;

the second groove path comprises:

a fourth recession in fluid communication with the first longitudinal hole, the first lateral slot, and the inlet zone;

a fifth recession in fluid communication with the second longitudinal hole, the second lateral slot, and the inlet zone;

the sixth face of the first bearing carrier comprises a third groove path configured to:

provide fluid communication between the first longitudinal hole, the first lateral slot, and the inlet zone; and provide fluid communication between the second longitudinal hole, the second lateral slot, and the inlet zone;

the third groove path comprises:

a sixth recession in fluid communication with the first longitudinal hole, the first lateral slot, and the inlet zone;

a seventh recession in fluid communication with the second longitudinal hole, the second lateral slot, and the inlet zone;

the third lateral face of the first bearing carrier, facing the inlet zone, comprises:

a third lateral slot configured to provide fluid communication between the third lateral slot and the third hole of the first bearing carrier;

a fourth lateral slot configured to provide fluid communication between the fourth lateral slot and the fourth hole of the first bearing carrier;

wherein the third lateral slot and the fourth lateral slot are in fluid communication with the inlet zone through the first channel, the third lateral slot, the fourth lateral slot, the first lateral slot, the first longitudinal hole, the second lateral slot, and the second longitudinal hole being in fluid communication with each other.

7. An external gear pump, comprising:

a casing with an inlet and an outlet;

a driver gear supported for rotation within the casing, disposed between the outlet and the inlet, and configured to rotate around a driver axis in a first rotational direction;

a driven gear supported for rotation within the casing, disposed between the outlet and the inlet, and configured to rotate around a driven axis in a second rotational direction opposite to the first rotational direction, and meshing with the driver gear in a mesh zone;

a first bearing carrier disposed in the casing at a first side of the casing;

a second bearing carrier disposed in the casing at a second side of the casing, opposite to the first side of the casing, the first bearing carrier further comprising a third hole and a fourth hole;

porting passageways disposed within the first bearing carrier;

a rear cover attached to the first side of the casing;

a front cover attached to the second side of the casing;

porting passageways disposed within the rear cover;

wherein the driver gear further comprises:

a first face and a second face;

a first hole extending inward from the first face;

a first live shaft extending outward from the second face;

a first plurality of teeth and a first plurality of root surfaces arranged alternately around the driver gear;

a first plurality of slots provided on the first plurality of root surfaces, each slot configured to provide fluid communication between the first hole and a respective first inter-teeth space between two consecutive teeth from the first plurality of teeth;

wherein the driven gear further comprises:

a third face and a fourth face;

a second hole extending inward from the third face;

a second live shaft extending outward from the fourth face;

a second plurality of teeth and a second plurality of root surfaces arranged alternately around the driven gear;

a second plurality of slots provided on the second plurality of root surfaces, each slot configured to provide fluid communication between the second hole and a respective second inter-teeth space between two consecutive teeth from the second plurality of teeth;

a first dead shaft disposed inside the first hole of the driver gear and the third hole of the first bearing carrier, fixedly attached to the first bearing carrier, the first dead shaft comprising:

a first longitudinal hole; and a first lateral slot on a first lateral face of the first dead shaft, configured to provide fluid communication between the first longitudinal hole and the first lateral slot;

a second dead shaft disposed inside the second hole of the driven gear and the fourth hole of the first bearing carrier, fixedly attached to the first bearing carrier, the second dead shaft comprising:

a second longitudinal hole; and a second lateral slot on a second lateral face of the second dead shaft, configured to provide fluid communication between the second longitudinal hole and the second lateral slot;

an inlet port at a third side of the casing, in fluid communication with an inlet zone disposed within the third side of the casing, the driver gear and the driven gear configured to draw fluid from the inlet port at the inlet zone;

an outlet port at a fourth side of the casing, in fluid communication with an outlet zone disposed within the fourth side of the casing, the driver gear and the driven gear configured to expel fluid to the outlet port at the outlet zone;

wherein:

the first lateral slot faces the outlet zone;

the second lateral slot faces the outlet zone;

the first longitudinal hole and the first lateral slot are in fluid communication with the outlet zone;

the second longitudinal hole and the second lateral slot are in fluid communication with the outlet zone;

when the first lateral slot aligns with the adjacent slots from the first plurality of slots, fluid communication is provided between the first inter-teeth space and the outlet zone through the first longitudinal hole, the first lateral slot, and the adjacent slots from the first plurality of slots;

when the second lateral slot aligns with the adjacent slots from the second plurality of slots, fluid communication is provided between the second inter-teeth space and the outlet zone through the second longitudinal hole, the second lateral slot, and the adjacent slots from the second plurality of slots.

8. The external gear pump of claim 7, wherein:

the rear cover comprises porting passageways;

the rear cover comprises a first groove path configured to:

provide fluid communication between the first longitudinal hole, the first lateral slot, and the outlet port; or provide fluid communication between the second longitudinal hole, the second lateral slot, and the outlet port;

the first groove path comprises:

a first recession in fluid communication with the first longitudinal hole and the first lateral slot;

a second recession in fluid communication with the second longitudinal hole and the second lateral slot;

a third recession in fluid communication with the outlet zone through a second channel, wherein the first recession, the second recession, and the third recession are in fluid communication with each other.

9. The external gear pump of claim 7, wherein:

the first bearing carrier further comprises additional porting passageways;

the first bearing carrier further comprises a fifth face, a sixth face, and a fourth lateral face;

the fifth face of the first bearing carrier comprises a second groove path configured to:

provide fluid communication between the first longitudinal hole, the first lateral slot, and the outlet zone; and provide fluid communication between the second longitudinal hole, the second lateral slot, and the outlet zone;

the second groove path comprises:

a fourth recession in fluid communication with the first longitudinal hole, the first lateral slot, and the outlet zone;

a fifth recession in fluid communication with the second longitudinal hole, the second lateral slot, and the outlet zone;

the sixth face of the first bearing carrier comprises a third groove path configured to:

provide fluid communication between the first longitudinal hole, the first lateral slot, and the outlet zone; and provide fluid communication between the second longitudinal hole, the second lateral slot, and the outlet zone;

the third groove path comprises:

a sixth recession in fluid communication with the first longitudinal hole, the first lateral slot, and the outlet zone;

a seventh recession in fluid communication with the second longitudinal hole, the second lateral slot, and the outlet zone;

the fourth lateral face of the first bearing carrier, facing the outlet zone, comprises:

a third lateral slot configured to provide fluid communication between the third lateral slot and the third hole of the first bearing carrier; and a fourth lateral slot configured to provide fluid communication between the fourth lateral slot and the fourth hole of the first bearing carrier;

wherein the third lateral slot and the fourth lateral slot are in fluid communication with the outlet zone through the second channel, the third lateral slot, the fourth lateral slot, the first lateral slot, the first longitudinal hole, the second lateral slot, and the second longitudinal hole being in fluid communication with each other.

* * * * *